US005659844A

United States Patent [19]

Fujiwara

[11] Patent Number: 5,659,844

[45] Date of Patent: Aug. 19, 1997

[54] FIXING DEVICE FOR THERMALLY FIXING TONER ONTO A PAPER SHEET AND HAVING A CONTROLLER FOR CONTROLLING THE AMOUNT OF HEAT RECEIVED BY THE PAPER SHEET

[75] Inventor: Tohru Fujiwara, Machida, Japan

[73] Assignee: Minolta Camera Kabushiki Kaisha, Osaka, Japan

[21] Appl. No.: 730,436

[22] Filed: Oct. 15, 1996

Related U.S. Application Data

[63] Continuation of Ser. No. 437,151, May 2, 1995, abandoned, which is a continuation of Ser. No. 111,654, Aug. 24, 1993, abandoned.

[30] Foreign Application Priority Data

| | | | |
|---|---|---|---|
| Aug. 26, 1992 | [JP] | Japan | 4-250675 |
| Aug. 26, 1992 | [JP] | Japan | 4-250676 |
| Aug. 31, 1992 | [JP] | Japan | 4-255641 |

[51] Int. Cl.[6] ..... G03G 15/20

[52] U.S. Cl. ..... 399/69; 399/328

[58] Field of Search ..... 399/67, 68, 69, 399/328

[56] References Cited

U.S. PATENT DOCUMENTS

| | | | |
|---|---|---|---|
| 4,303,334 | 12/1981 | Haupt et al. | 355/133 |
| 4,652,110 | 3/1987 | Sato et al. | 355/282 X |
| 4,941,021 | 7/1990 | Uchida et al. | 355/285 |
| 5,115,279 | 5/1992 | Nishikawa et al. | 355/290 |
| 5,162,855 | 11/1992 | Nakagama et al. | 355/285 |
| 5,170,215 | 12/1992 | Pfeuffer | 355/285 |
| 5,206,694 | 4/1993 | Ohira et al. | 355/290 |
| 5,289,247 | 2/1994 | Takano et al. | 355/285 |

*Primary Examiner*—Fred L. Braun
*Attorney, Agent, or Firm*—Sidley & Austin

[57] ABSTRACT

A fixing device which changes the amount of heat received by a recording paper in accordance with a portion of the recording paper with respect to a paper transporting direction. The fixing device controls a heater for heating a fixing member so as to raise the temperature of the fixing member when a trailing half of the recording paper is disposed between the fixing member and a pressure member, or controls the heater so as to decrease the temperature of the fixing member when either one of a leading end and a trailing end of the recording paper is disposed between the fixing member and the pressure member. For another example, the fixing device controls, when a recording paper is fed from the feeding tray, at least either one of the rotation of the pressure roller and the transportation of the recording paper so as not to make the leading end of the recording paper contact with a portion of the exterior circumference of the pressure roller which is in contact with the fixing roller when the pressure roller is stopped.

17 Claims, 24 Drawing Sheets

(1) paper sensor ON → T4 start (2) T1 end → control target temp. 145°C or heater OFF (3) T2 end → control target temp. 150°C (4) T3 end → control target temp. 155°C or heater ON (5) paper sensor OFF (6) T4 end → control target temp. 145°C or heater OFF (7) T5 end → control target temp. 150°C C
D
4
5
6
7
S940
T3 end?
YES
NO
S941
T3 count up
S942
PSST ← 5
S943
set FORCE ON flag
S944
start FORCE ON timer
S950
PS OFF?
YES
NO
S951
trouble detection
S952
FORCE ON timer end?
YES
NO
S953
count up FORCE ON timer
S954
reset FORCE ON flag
S955
T4 start
S956
PSST ← 6
S960
T4 end?
YES
NO
S961
T4 count up
S962
T5 start
S963
PSST ← 7
S964
set FORCE ON flag
S970
T5 end?
YES
NO
S971
T5 count up
S972
PSST 0
S973
reset FORCE ON flag

FIXING DEVICE FOR THERMALLY FIXING TONER ONTO A PAPER SHEET AND HAVING A CONTROLLER FOR CONTROLLING THE AMOUNT OF HEAT RECEIVED BY THE PAPER SHEET

This application is a continuation of application Ser. No. 08/437,151, filed on May 2, 1995, now abandoned, which in turn is a continuation of application Ser. No. 08/111,654, filed on Aug. 24, 1993, now abandoned.

BACKGROUND OF THE INVENTION

1. Field of the Invention

The present invention relates to a fixing device, and more specifically relates to a fixing device of the thermal type for use in copying apparatus, laser printers and the like which use an electrophotographic process.

2. Description of the Related Art

Copying apparatus, laser printers and the like which use an electrophotographic process typically are provided with a fixing device for fusing a toner image onto a paper sheet. Such fixing devices generally comprise a fixing roller having an internal heater, and a pressure roller disposed so as to confront said fixing roller. The fixing roller receives the heat generated by the internal heater to elevate the temperature to a predetermined temperature (about 150 degrees C.), whereas the pressure roller is heated via the fixing roller. Temperature fluctuation of fixing devices having the aforesaid construction are described below with reference to FIG. 23.

In the drawing, reference numeral 2301 refers to the temperature change on the surface of the fixing roller. When the printing operation of a laser printer and the like is started and an electric current is applied to the heater, the temperature of the fixing roller is elevated to about 150 degrees C. (t1) and the temperature of the pressure roller is also elevated by receiving the heat of the fixing roller. At the moment the leading edge of a fed sheet arrives between the aforesaid rollers (t2), the surface temperature of the pressure roller has been elevated to about 100 degrees C. Then, the toner image on the surface of the paper sheet is fused via the heat from the fixing roller and the pressure roller so as to be fixed thereon.

The amount of heat maintained by the pressure roller during the passage of the sheet between the rollers (t2–t3) is affected by the paper and the toner, such that the surface temperature of the pressure roller is reduced. When the trailing edge of the paper sheet is removed from between the two rollers (t3), the pressure roller is again heated by the fixing roller, such that the surface temperature of the pressure roller is again elevated (t3–t4).

The fixed strength of the fixed toner is shown in FIG. 24. This drawing shows the fixed strength of the toner on each part of the paper sheet relative to the transport direction. As previously mentioned, sufficient heat is applied to the leading half of the paper sheet (in the sheet transport direction), and the toner penetrates into the fibers of the paper. Therefore, the fixed strength (reference numeral 2401 in the drawing) of the toner is excellent in the leading half of the paper. However, since the temperature of the pressure roller is subject to a drop due to the loss of the heat of the pressure roller, such that the toner on the trailing half of the paper sheet is inadequately fused to the sheet on the trailing half of said sheet. Therefore, the fixed strength of the toner is insufficient in the trailing half of the paper sheet (reference numeral 2402 in the drawing), and the toner readily separates from said sheet and thereby results in the disadvantage of poor toner adhesion. Such a disadvantage is common in fixing devices provided with a pressure roller of small diameter and/or slight heating capacity.

Although the poor toner adhesion on the trailing half of the paper sheet may be eliminated by raising the temperature of the fixing roller, such a remedy produces new disadvantages such as high temperature offset and the like because the toner on the leading half of the sheet is overheated.

That is, in conventional fixing devices, the total amount of heat applied to the leading half of the paper sheet by the fixing roller and the pressure roller, and the total amount of heat applied to the trailing half of the sheet by the fixing roller and the pressure roller are different. Thus, there is a problem in adequately fixing the toner along the entirety of the leading half and the trailing half of the sheet.

Furthermore, because the pressure roller temperature is raised via the heat of the fixing roller, the moisture contained in the paper sheet is vaporized via said heat applied by the fixing roller when the paper passes through the aforesaid fixing device. The vaporization of the moisture produces a curling of the ends of the paper sheet, as shown in FIG. 25. The curl in the center portion of the paper sheet is only slightly apparent since the curl is straighten due to own weight of the ends of said sheet. While the fixing temperature may be reduced so as to correct the aforesaid curl, the toner fixed strength is reduced thereby, producing a new disadvantage inasmuch as the toner readily separates from the paper.

When a laser printer is in the wait state, the fixing roller 2610 and the pressure roller 2620 are stopped, as shown in FIG. 26. In order to shorten the time for raising the temperature when a printing operation starts, the temperature of the fixing roller 2610 is maintained at 100 to 150 degrees C. During the wait period, therefore, the nip portion of the pressure roller 2620 (the portion of contact between the fixing roller 2610 and the pressure roller 2620) becomes an area of high temperature. In the drawing, the area of the dashed lines of the pressure roller 2620 indicates the high temperature area. The portion of the pressure roller 2620 heated by the fixing roller 2610 in the wait state is called the high temperature area hereinafter.

When the laser printer starts a printing operation, the fixing roller 2610 and the pressure roller 2620 are rotated, but even after the pressure roller 2620 begins to rotate the high temperature area of said pressure roller 2620 remains higher in temperature than other parts of said roller. As shown in FIG. 27, when the high temperature area of the pressure roller 2620 forms the nip portion, the leading edge of the paper sheet (the leading edge of the sheet in the paper transport direction) reaches the nip portion, and the leading edge of the paper in contact with the high temperature area on the circumference of the pressure roller 2620 becomes higher in temperature than other parts of the paper sheet. Thus, the moisture contained in the leading edge part of the paper is excessively vaporized, and a curl is produced in the leading edge.

FIG. 28 is a graph showing the change in temperature in the nip portion of the pressure roller 2620. When the pressure roller 2620 starts to rotate simultaneously with the start of a printing operation and completes a single rotation, the high temperature area of the pressure roller 2620 again arrives at the nip portion. The previously described curl is similarly produced at the moment at which the high temperature area of the pressure roller 2620 which has rotated m times arrives at the nip portion (time t1) and the leading edge of the paper sheet is gripped between the rollers at the nip portion. When the center part of the paper sheet comes into contact with the high temperature area of the pressure roller 2620, this center part of the paper becomes higher in temperature than other parts of the paper yet the aforesaid curl is only slightly apparent. As previously described, the curl in the center portion of the paper sheet is straightened due to the weight of both ends of the paper.

SUMMARY OF THE INVENTION

A main object of the present invention is to provide a fixing device capable of accomplishing superior fixing throughout both the leading half portion and the trailing half portion of a paper.

A further object of the present invention is to provide a fixing device capable of reducing paper curl without causing poor fixing.

An even further object of the present invention is to prevent paper curl caused through contact of the leading edge portion of a paper with the high temperature area of the pressure roller.

A still further object of the present invention is to provide a fixing device capable of feeding paper with a timing whereby the leading edge of said paper does not make contact with the high temperature area of the pressure roller.

These and other objects of the present invention are achieved by providing a fixing device comprising a fixing member heated by a heater, a pressure member for making pressure contact with said fixing member so as to thermally fix onto a paper an unfixed toner which is adhered thereto by transporting said paper between said fixing member and said pressure member, and a control means for controlling the heater so as to increase the total heat generating amount of the heater when the trailing half of the paper in a paper transporting direction is disposed between the fixing member and the pressure member in comparison to the total heat generating amount of the heater when the leading half of the paper in a paper transport direction is disposed between the fixing member and the pressure member.

These and other objects of the present invention are further achieved by providing a fixing device comprising a fixing member heated by a heater, a pressure member for making pressure contact with said fixing member so as to thermally fix onto a paper an unfixed toner which is adhered thereto by transporting said paper between said fixing member and said pressure member, and a control means for controlling the heater so as to reduce the amount of heat applied to the paper by the fixing member per unit area of at least one of a leading end portion of the paper and a trailing end portion of the paper in a paper transporting direction compared to the amount of heat applied by the fixing member per unit area of the remaining portions of the paper.

These and other objects of the present invention are further achieved by providing a fixing device comprising a fixing roller heated by a heater, a pressure roller for making pressure contact with said fixing roller so as to thermally fix onto a paper an unfixed toner which is adhered thereto by transporting said paper between said fixing roller and said pressure roller, transporting means for feeding and transporting a recording paper from a feeding tray to the fixing roller and the pressure roller, and control means for controlling, when a recording paper is fed from the feeding tray, at least one of the rotation of the pressure roller and the transportation of the paper by the transporting means so as to make the leading edge of the paper in a paper transporting direction contact with a portion of the exterior circumference of the pressure roller which is not in contact with the fixing roller when the pressure roller is stopped.

These and other objects, advantages and features of the invention will become apparent from the accompanying description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 11(*b*) is an illustration showing the fixed strength of the toner fixed via the fixing device of the first and second embodiments of the present invention;

FIG. 25 is an illustration showing the paper curl when a paper fixed by a conventional fixing device is placed on a base or the like;

DETAILED DESCRIPTION OF THE PREFERRED EMBODIMENTS

The preferred embodiments of the present invention are described hereinafter with reference to the accompanying drawings.

Figure 1:
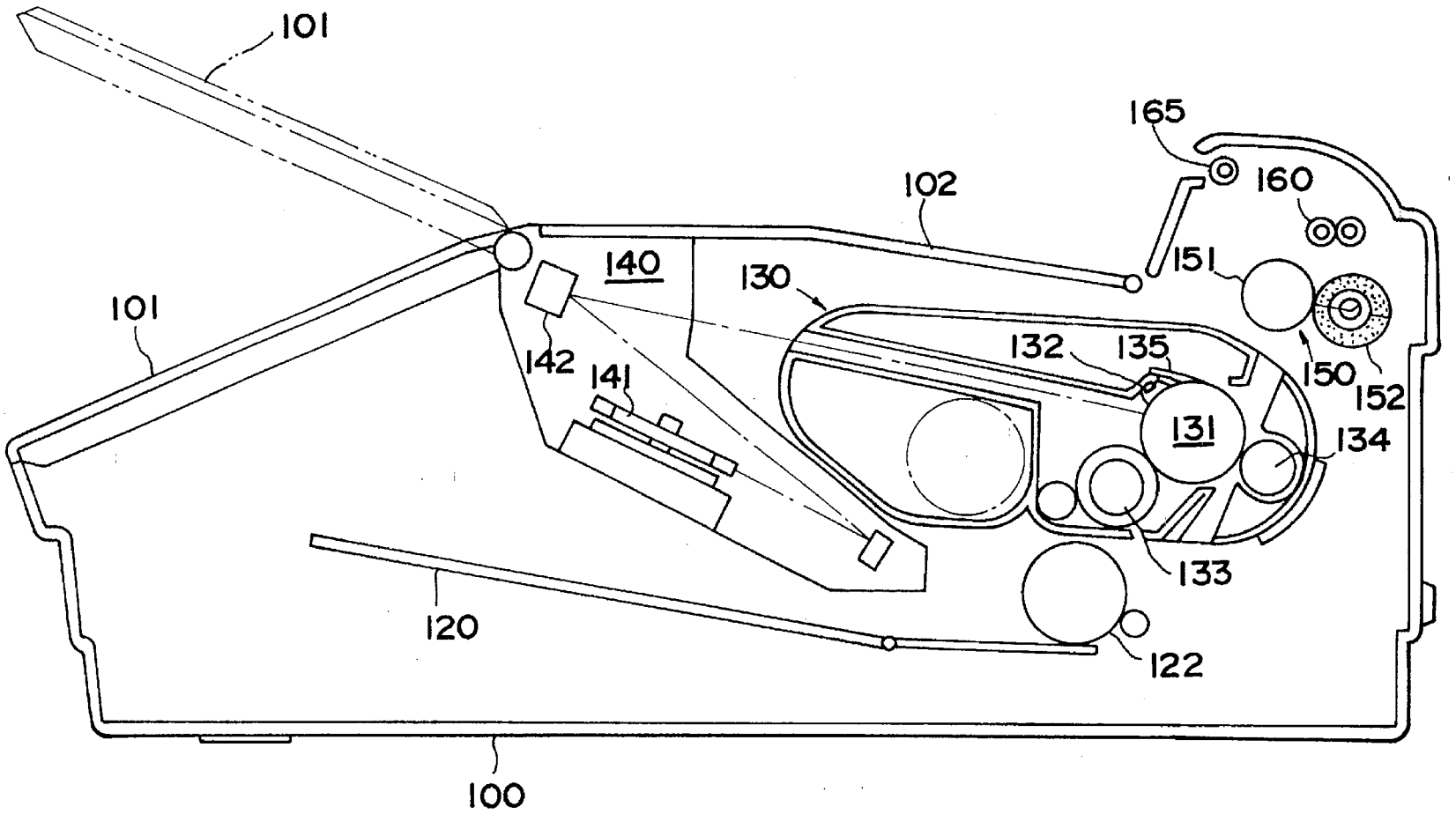
FIG. 1 is a section view showing a laser printer using the fixing device of the first, second and third embodiments of the present invention.

FIG. 1 is a section view of a laser printer using a first embodiment of the fixing device of the present invention.

Within the body cover 100 are arranged a paper feed tray 120 for accommodating paper, image forming cartridge 130 comprising a photosensitive drum 131 and the like, optical unit 140, fixing device 150 and the like. These components are normally referred to as the engine.

A paper feed roller 122 is provided in proximity to the paper tray 120, said feed roller 122 having the function of transporting paper from the paper tray 120 to the image forming cartridge 130. A photosensitive drum 131 provided within the removably installed image forming cartridge 130 is rotatable in the counterclockwise direction in the drawing. A charging lamp 132 is provided in proximity to the photosensitive drum 131. The surface of the photosensitive drum 131 is charged to a predetermined electric potential by the charging lamp 132. The charged surface of the photosensitive drum 131 is irradiated by a laser beam emitted from the optical unit 140 so as to form an electrostatic latent image thereon. The optical unit 140 comprises a semiconductor laser 141, polygonal mirror 142 and the like. The developing device 133 forms a toner image by adhering toner possessing insularity on the aforesaid electrostatic latent image. The transfer roller 134 has the function of transferring the toner image formed on the surface of the photosensitive drum 131 onto the paper sheet. A blade 135 is provided at a position of contact with the photosensitive drum 131 so as to remove residual toner therefrom. The fixing device 150 is disposed above the photosensitive drum 131 to fix the toner onto the paper.

The aforesaid fixing device 150 comprises a fixing roller 151 provided with an internal halogen lamp heater, and a pressure roller 152 which makes pressure contact with said fixing roller 151. Above the fixing roller 151 are provided a pair of transport rollers 160 and a discharge roller 165. At the top of the main unit cover 100 is provided a discharge tray 102 for accommodating the paper discharged via the transport roller pair 160 and discharge roller 165. An openable door 101 is also provided at the top of the main unit cover 100. The door 101 is opened when resupplying paper to the paper supply tray 120 and the like. Although not illustrated in FIG. 1, a control circuit 20 is provided within the main unit cover 100 to control the internal heater of the fixing roller 151.

Figure 2:
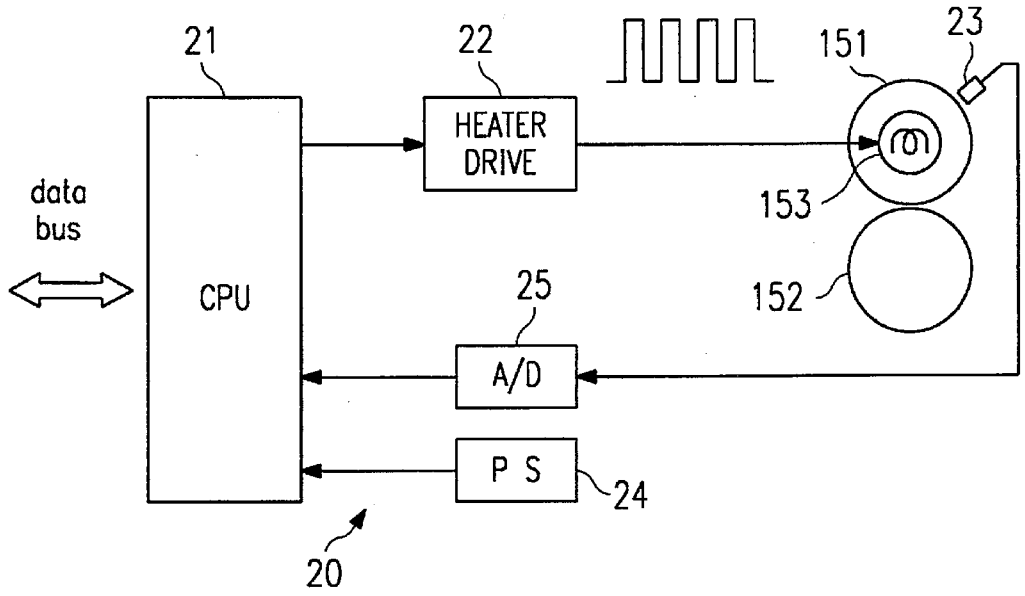
FIG. 2 is a block diagram of the control circuit of the fixing device of the first and second embodiments of the invention.

A block diagram of the aforesaid control circuit 20 is shown in FIG. 2. In the drawing, the central processing unit (CPU) 21, which is connected to a data bus, executes predetermined processing in accordance with the operating sequences written in the program ROM (read only memory). The output signals of the thermistor 23 are input to the aforesaid CPU 21 via the analog-to-digital (A/D) converter 25. The thermistor 23 is disposed in proximity to the fixing roller 151 to detect the surface temperature of said fixing roller 151. The signals output from the thermistor 23 are converted to digital signals by the A/D converter 25, which are then input to the CPU 21.

The CPU 21 transmits binary signals to the heater drive circuit 22 based on the aforesaid digital signals. Thus, the heater drive circuit 22 which includes thyristor and the like performs a switching operation so as to turn the heater 153 on and off. That is, the heater 153 is binary controlled. Signals emitted from the paper sensor 24 are also input to the CPU 21. The paper sensor or identifying means 24 is disposed in the paper transport path in proximity to the fixing device 150, so as to detect the leading edge of the paper transported to the fixing device 150.

The heat generated by the heater 153 may be controlled (continuous control) by analogically changing the voltage applied to the heater 153. Furthermore, the pulse duty ratio applied to the heater 153 may be continuously changed by constructing the heater drive circuit 22 using an inverter circuit.

Figure 3:
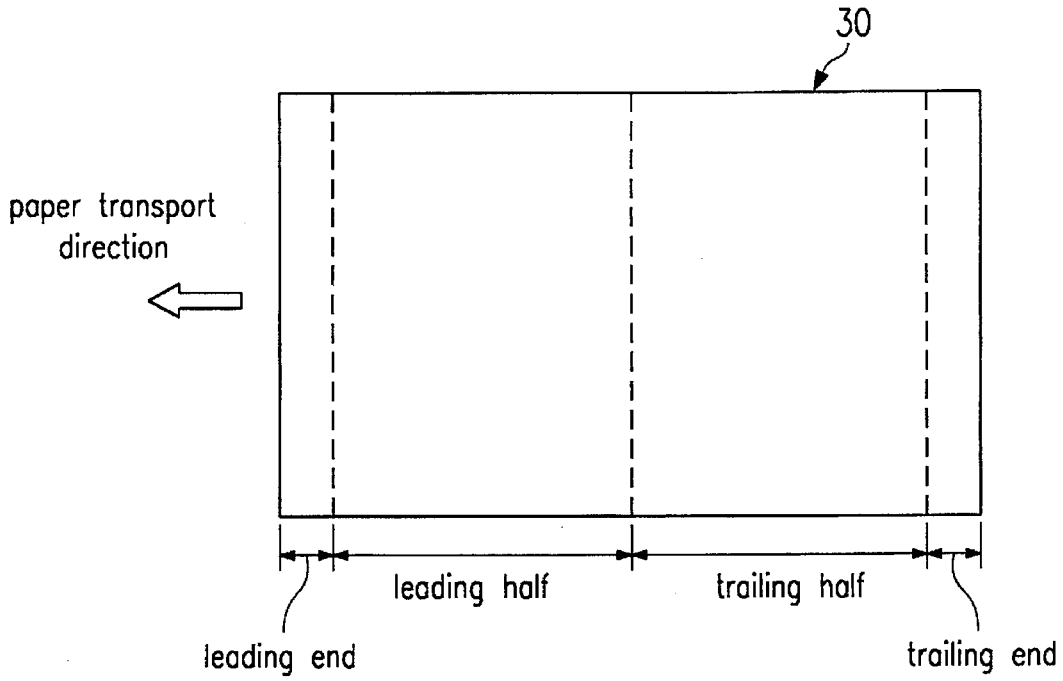
FIG. 3 is an illustration describing the various parts of the paper relating to the first and second embodiments of the invention.

Before describing the operation of the fixing device of the aforesaid construction, we first describe each part of the paper with reference to FIG. 3. In the drawing, reference numeral 30 refers to the paper sheet, and the arrow indicates the transport direction (direction in which the paper is transported to the fixing device). The paper 30 has four sections relative to the sheet transport direction, which are defined as: leading end, leading half, trailing half, trailing end. The boundary of the leading half and trailing half forms the center of the paper. The sheet leading end and trailing end are areas in which image formation seldom occur, e.g., a range of about 2 cm from the paper edge.

The operation of the fixing device of the first embodiment of the present invention is described hereinafter.

Figure 4:
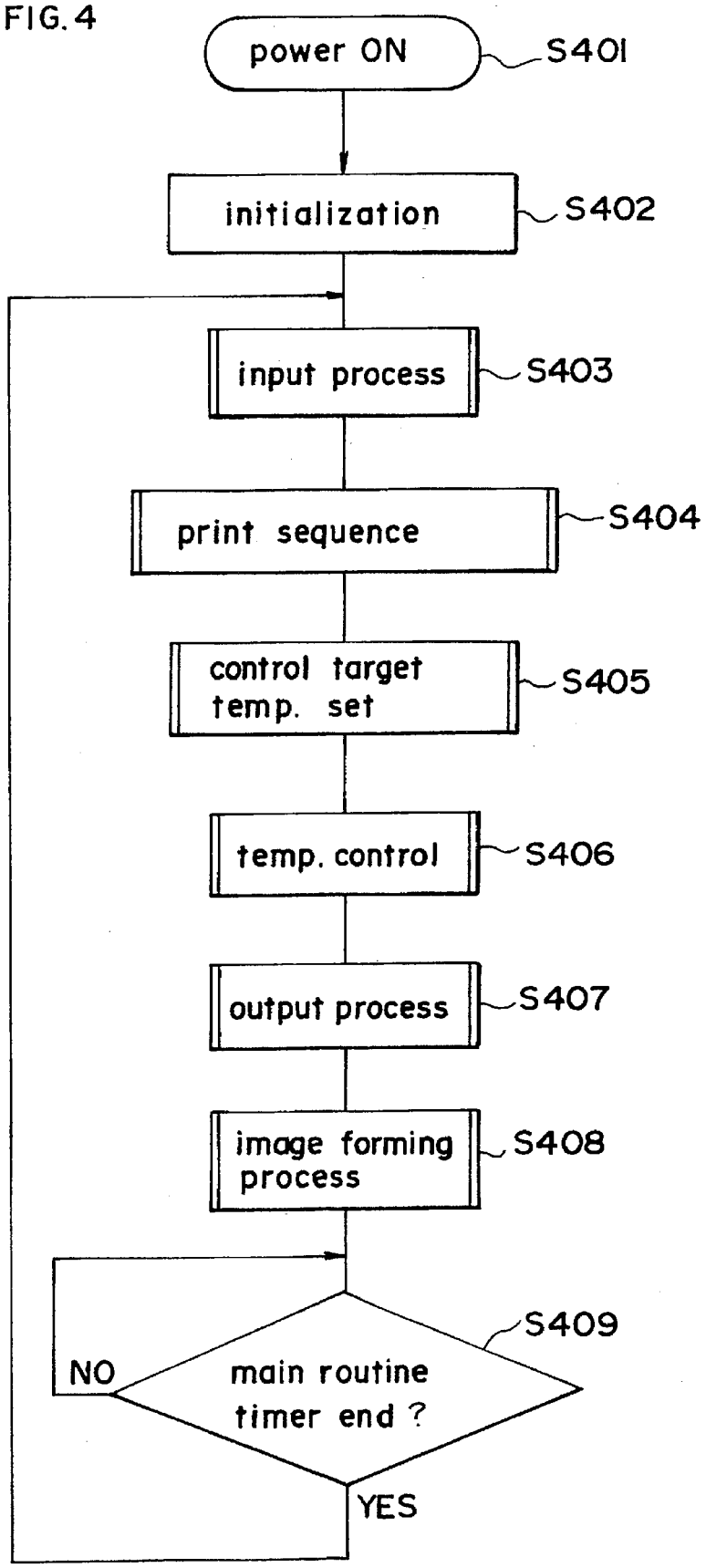
FIG. 4 is a main flow chart showing the operation of the fixing device of the first and second embodiments of the invention.

FIG. 4 is a main flow chart showing the operation of the present fixing device. When an operator turns on the power supply of the laser printer (step S401), the CPU 21 of the aforesaid control circuit 20 initializes the values of all internal registers and the like (step S402). At the same time, the main routine timer counting operation is started to determine the execution cycle of the main flow chart. The CPU 21 receives data from the operation panel and the like via the bus, as well as signals from the thermistor 23 (step S403). Thereafter, the control means 20 controls the operations of the image forming cartridge 130, optical unit 140 and the like (step S404).

In step S405, the control target temperature for the surface of the fixing roller 151 is set in accordance with the subroutine described below. The heater 153 is controlled so as to have the surface temperature of the fixing roller 151 conform to the control target temperature (step S406). Thereafter, the CPU 21 executes predetermined input/output (I/O) operations via the bus and I/O ports and the like (steps S407, S408). Then, when the main routine timer reaches a predetermined value (step S409: YES), the routine returns to the previously described step S403 and the main flow chart operation is repeated.

Figure 5:
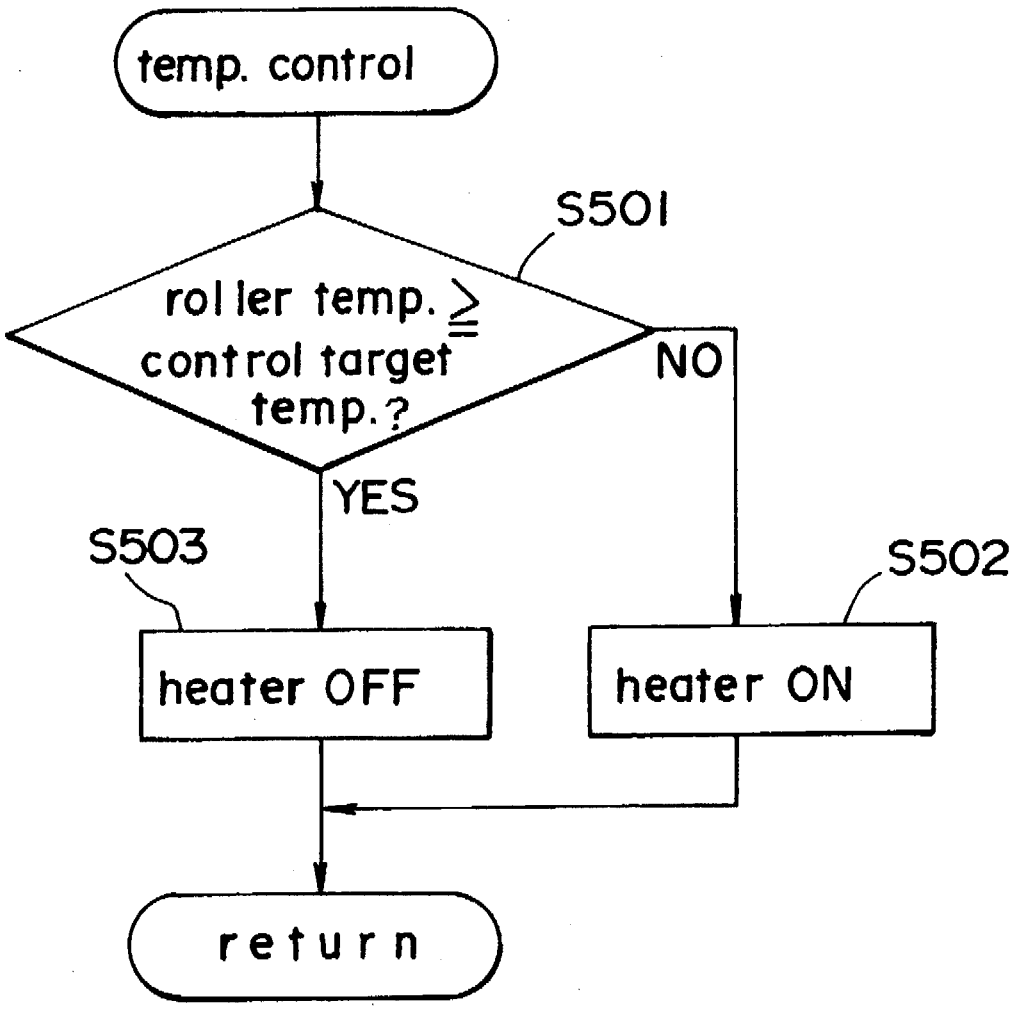
FIG. 5 is a subroutine showing the temperature control process of the fixing device of the first embodiment of the invention.

FIG. 5 shows the temperature control subroutine of step S406. In step S501, a check is made to determine whether or not the surface temperature of the fixing roller 151 detected by the thermistor 23 is equal to or greater than the control target temperature set in step S405. When the surface temperature of the fixing roller 151 is equal to or greater than the control target temperature (step S501: YES), the heater 23 is turned off (step S503). On the other hand, when the surface temperature of the fixing roller 151 is less than the control target temperature (step S501: NO), the heater 23 is turned on (step S502). Thus, the surface temperature of the fixing roller 151 is controlled so as to conform to the control target temperature.

Figure 6:
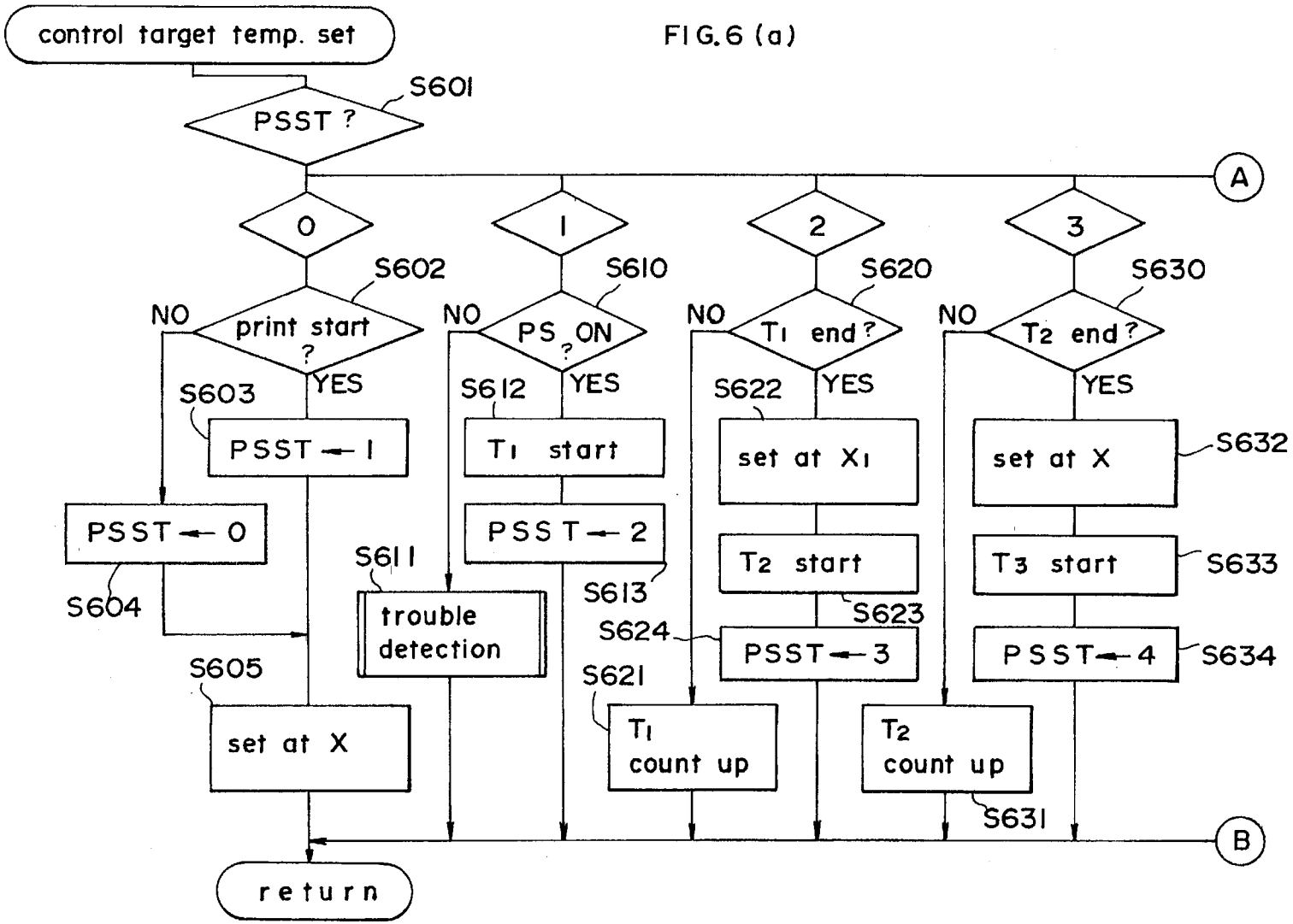
FIG. 6(*a*) and FIG. 6(*b*) are a subroutine showing the control target temperature setting process of the fixing device of the first embodiment of the invention.
Figure 6:
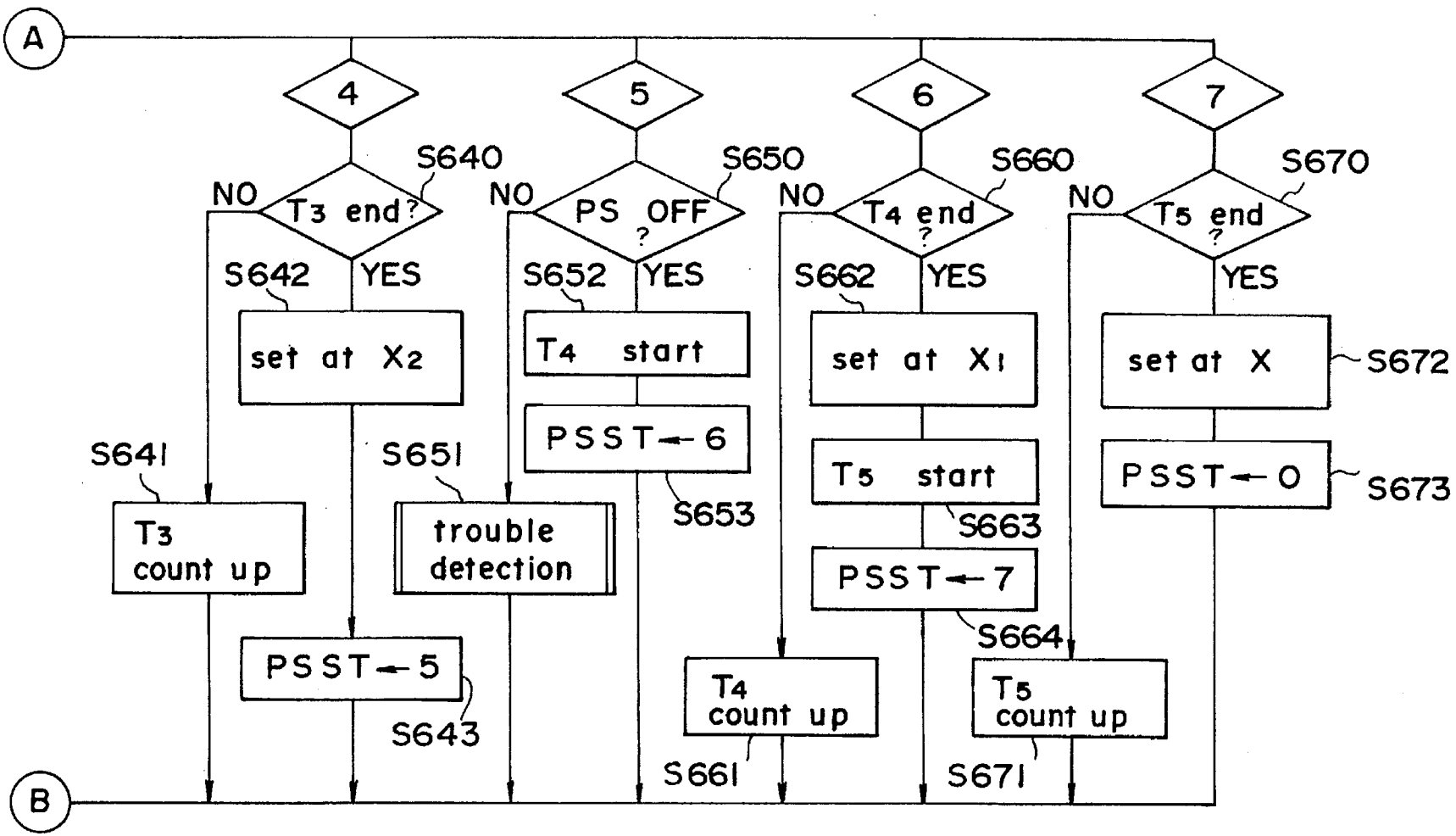

FIGS. 6(*a*) and 6(*b*) show the subroutine of the control target temperature setting process of step S405. The variables used in this subroutine are described below. The status PSST changes the values relating to the positional relationship between the paper and the fixing device 150, such that the control target temperature value is set via the status PSST value (0~7). The timers T1, T2, T3, T4, and T5 are set at variables incremented via the status PSST value and the like. X, X1 and X2 are constants expressing the control target temperature of the surface of the fixing roller 151, e.g., x=150 degrees C., X1=145 degrees C., X2=155 degrees C. This subroutine is described more fully below.

The control means 20 determines whether or not to execute any of the processes via the status PSST value (step S601). When this subroutine begins execution, the status PSST value remains [0] (initial value). Thus, processes of step S602 and subsequent steps are executed. That is, a determination is made in step S602 as to whether or not to start a print operation, and if a print operation has not yet started, the status PA value is set at [0] (step S604). On the other hand, if a print operation has already started, the status PA value is set at [1] (step S603).

Then, the control target temperature is set to the normal fixing temperature X (150 degrees C.) (step S605), and the subroutine returns to the main flow chart shown in FIG. 4. In the main flow chart, the heater 153 is controlled so as to have the surface temperature of the fixing roller 151 coincide with the control target temperature X (150 degrees C.) (step S406 in FIG. 4). Accordingly, when a print operation starts, the surface temperature of the fixing roller 151 is regulated at 150 degrees C., and the temperature of the pressure roller 152 residing in contact with the surface of said fixing roller 151 is also elevated.

Then, whenever jumping from the main flow chart to this subroutine, the status PA value is already set at [1]. Therefore, the processes of step S610 and subsequent steps are executed. The CPU 21 determines whether or not the paper sensor 24 is turned ON, i.e., whether or not the leading edge of the paper discharged from the image forming cartridge 130 has arrived at the paper sensor 24 disposed in proximity to the fixing device 150 (step S610). When the paper sensor 24 is in the OFF state because the leading edge of the sheet has not yet arrived at the paper sensor 24 (step S610: NO), the trouble detector timer is started (step S611), and the subroutine returns to the main flow chart. If the paper sensor 24 has not been turned ON after a predetermined time has elapsed, even if the trouble detector timer has arrived at a predetermined value (step S610: NO), a paper jam or the like is assumed to have occurred, and the error display and like processes are executed.

Figure 7:
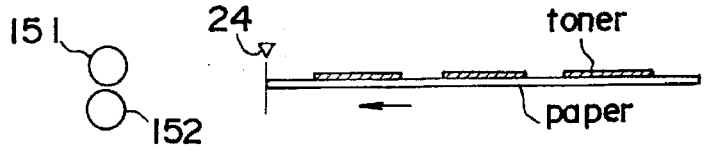
FIG. 7 is an illustration showing the positional relationship of the paper and the fixing devices of the first and second embodiments of the invention.
Figure 7:
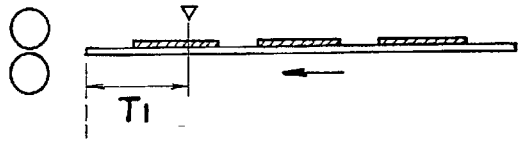
Figure 7:
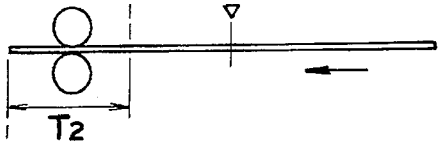
Figure 7:
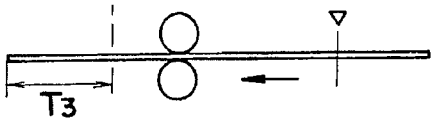
Figure 7:
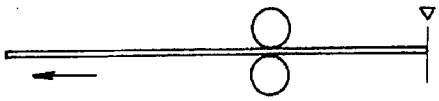
Figure 7:
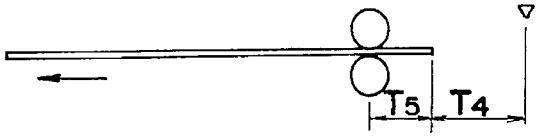
Figure 7:
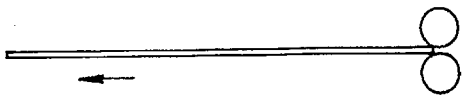

On the other hand, when the paper sensor 24 is turned ON as the paper passes said sensor 24 in step S610, the timer T1 counting operation is started (step S612). The status PSST value is set at [2] (step S613), and the subroutine returns to the main flow chart. The state at this time is shown in FIG. 7(1). FIG. 7 shows the relative positional relationships among the paper, paper sensor 24, and fixing roller 151. As shown in FIG. 7(1), the paper sensor 24 is turned ON via the passage of the leading edge of the paper past the paper sensor 24 disposed in front of the fixing roller 151.

Then, whenever this subroutine is executed, step S620 is executed because the status PSST value is set at [2]. In step S620, a determination is made as to whether or not the timer T1 which was previously started has reached a predetermined value, i.e., whether or not the leading edge of the paper has past the paper sensor 24 and subsequently reached proximity to the fixing roller 151. When the timer T1 counting operation has not been completed (step S620: NO), the timer T1 is incremented (step S621), and the subroutine returns to the main flow chart because the leading edge of the paper has not reached proximity to the fixing roller 151.

However, when the timer T1 counting operation is completed in step S620, the control target temperature is set at X1 (145 degrees C.) because the leading edge of the paper has reached the fixing roller 151 (step S622), to wit, the control target temperature is reduced from 150 degrees C. to 145 degrees C. Then, the timer T2 counting operation is started (step S623), the status PSST value is set at [3] (step S624), and thereafter the subroutine returns to the main flow chart. In the main flow chart, the heater is controlled (step S406 in FIG. 4) so as to have the surface temperature of the fixing roller 151 coincide with the control target temperature (145 degrees C.). The paper position at this time is shown in FIG. 7(2). Thus, the surface temperature of the fixing roller 151 is lowered whenever the leading edge of the paper passes in leading of the fixing roller 151.

Subsequently, whenever this subroutine is executed, the step S630 is executed because the status PSST value is set at [3]. In step S630, a determination is made as to whether or not the timer T2 which was previously started has reached a predetermined value, i.e., whether or not the front half of the paper (defined in FIG. 3) has passed the fixing roller 151. When the result of the aforesaid determination is NO, the timer T2 is incremented (step S631) and thereafter the subroutine returns to the main flow chart. Thus, the fixing of the leading half of the paper is accomplished at the fixing temperature X1 which is lower than the normal fixing temperature X. Paper curl is reduced in the leading end of the paper by reducing the amount of heat applied to the leading end of the paper.

When, however, the timer T2 has completed the counting operation in step S630, the control target temperature is set at X (150 degrees C.) because the leading end of the paper has passed the fixing roller 151 (step S632). That is, the control target temperature is returned to the normal fixing temperature of 150 degrees C. from 145 degrees C. Then, the timer T3 is started (step S633), the status PSST value is set at [4] (step S634), and thereafter the subroutine returns to the main flow chart. In the main flow chart the heater is controlled so as to have the surface temperature of the fixing roller 151 coincide with the control target temperature (150 degrees C.) (step S406 in FIG. 4). That is, after the leading end of the paper has past the fixing roller 151, and until the leading half of the paper (defined in FIG. 3) has past the fixing roller 151, the surface temperature of the fixing roller 151 is regulated to 150 degrees C. The paper position at this time is shown in FIG. 7(3).

Then, whenever this subroutine is executed, step S640 is executed because the status PSST value is set at [4]. In step S640, a determination is made as to whether or not the timer T3 which was previously started has reached a predetermined value, i.e., whether or not the leading half of the paper has past the fixing roller 151. When the leading half of the paper has not completed its passage of the fixing roller 151 (step S640: NO), the timer T3 is incremented (step S641), and thereafter the subroutine returns to the main routine. Thus, the leading half of the paper is fixed at the normal fixing temperature X (150 degrees C.).

When, however, the leading half of the paper has completed passage of fixing roller 151 and the center portion of the paper reaches the fixing roller 151, the timer T3 counting operation ends. Therefore, the result of the determination in step S640 is YES, and the control target temperature is set at X2 (155 degrees C.) (step S642). That is, the control target temperature is elevated from 150 degrees C. to 155 degrees C. Then, after the status PSST value is set at [5] (step S643), the subroutine returns to the main flow chart. Then, the heater is controlled so as to have the surface temperature of the fixing roller 151 coincide with the control target temperature (155 degrees C.) (step S406 in FIG. 4). The paper position at this time is shown in FIG. 7(4).

Therefore, the temperature of the fixing roller 151 is elevated during the passage of the trailing half of the paper past the fixing roller 151. The temperature of the pressure roller 152 is also elevated via the heat of the fixing roller 151. Accordingly, the temperature drop of the pressure roller 152 can be suppressed because the heat of the pressure roller 152 is absorbed by the paper and the toner. Therefore, the total amount of heat received by the leading half of the paper rendered equal to the total amount of heat received by the trailing half of the paper, such that superior fixing is accomplished across the entirety of the leading half and trailing half of the paper.

Then, whenever the aforesaid subroutine is executed, step S650 is executed because the status PSST value is set at [5]. In step S650, a determination is made as to whether or not the paper sensor 24 is in the OFF state, i.e., whether or not the trailing end of the paper has passed the paper sensor 24. When the result of the aforesaid determination is NO, the trouble detector timer counting operation is started (step S651), and the subroutine returns to the main flow chart. Thereafter, if the paper sensor 24 is OFF after a predetermined time has elapsed, i.e., if the trailing end of the paper has not passed the paper sensor 24, even if the trouble detector timer has arrived at a predetermined value, a paper jam or the like is assumed to have occurred in the fixing device 150. In such an instance, the error display and like predetermined processes are executed.

On the other hand, when the trailing end of the paper has passed the paper sensor 24, the result of the discrimination in step S650 is YES. In this instance, the counting operation of the timer T4 is started (step S652), the status PSST value is set at [6] (step S653), and thereafter the subroutine returns to the main flow chart. The position of the paper at this time is shown in FIG. 7(5).

Then, whenever the aforesaid subroutine is executed, step S660 is executed because the status PSST value is set at [6]. In step S660, a determination is made as to whether or not the timer T4 which was previously started has reached a predetermined value, i.e., whether or not the trailing end of the paper has arrived at the fixing roller 151 after a predetermined time period has elapsed since the trailing end of the paper (defined in FIG. 3) passed the paper sensor 24. When the trailing end of the paper has not yet arrived at the fixing roller 151 (step S660: NO), the timer T4 is incremented (step S661), and thereafter the subroutine returns to the main flow chart.

When, in step S660, the timer T4 reaches a predetermined value and the trailing end of the paper enters the fixing roller 151 as shown in FIG. 7(6), the control target temperature is set at X1 (145 degrees C.) (step S662). That is, the control target temperature is reduced from 155 degrees C. to 145 degrees C. Then, the timer T5 counting operation is started (step S663), the status PSST value is set at [7] (step S664), and thereafter the subroutine returns to the main flow chart. In the main flow chart, the heater is controlled to have the surface temperature of the fixing roller 151 coincide with the control target temperature X1 (145 degrees C.) (step S406 in FIG. 4).

Therefore, the surface temperature of the fixing roller 151 has been regulated so as to be reduced when the trailing end of the paper passes the fixing roller 151. Accordingly, the amount of heat which the trailing end of the paper receives from the fixing roller 151 and the pressure roller 152 is relatively slight compared that received by leading half and the trailing half portions of said paper. Thus, the moisture content of the trailing end of the paper is not excessively vaporized, thereby reducing the curl in said trailing end portion of the paper.

When the aforesaid subroutine is executed, step S670 is executed because the status PSST value is set at [7]. In step S670, a determination is made as to whether or not the timer T5 which was previously started has reached a predetermined value, i.e., whether or not the trailing end of the paper has separated from the fixing roller 151. When the result of the determination is NO, the timer T5 is incremented (step S671), and thereafter the subroutine returns to the main flow chart.

On the other hand, when the timer T5 reaches a predetermined value in step S670 and the trailing end of the paper has separated from the fixing roller 151 as shown in FIG. 7(7), the control target temperature is set at X (150 degrees C.) (step S672). That is, the control target temperature is returned to 150 degrees C. from 145 degrees C. Then, the status PSST value is returned to [0] (step S673), and thereafter the subroutine returns to the main flow chart.

Thus, the control target temperature is set via the positional relationship between the paper and the fixing roller 151. In step S407 of the main flow chart, control is executed so as to have the surface temperature of the fixing roller 151 coincide with the aforesaid control target temperature.

Figure 10:
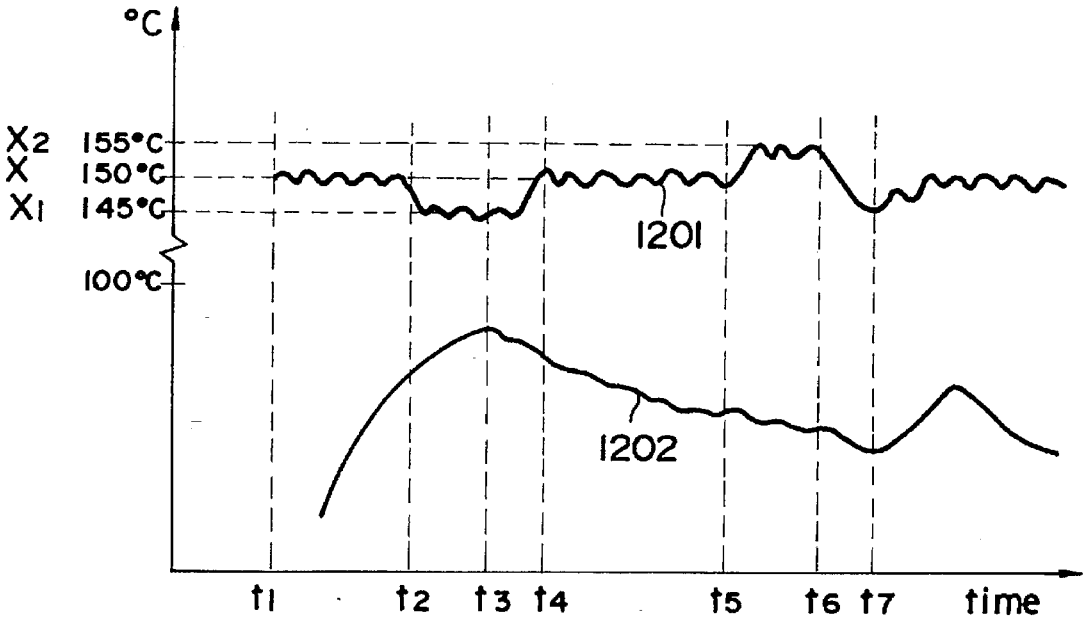
FIG. 10 is a graph showing the change in temperature of the fixing roller and the pressure roller of the first and second embodiments of the present invention.

FIG. 10 is a graph showing the change in surface temperatures of the fixing roller 151 and the pressure roller 152 in the fixing device of the present embodiment.

In the drawing, reference numeral 1201 refers to the surface temperature of the fixing roller 151, and reference numeral 1202 refers to the surface temperature of the pressure roller 152. The change in these temperatures is described hereinafter in accordance with the operation of a laser printer.

When the laser printer printing operation is started and electrical current is supplied to the heater, the temperature of the fixing roller 151 is elevated to about 150 degrees C. (t1).

The temperature of the pressure roller 152 is also elevated via the reception of the heat of the fixing roller 151. When the leading edge of the transported paper sheet arrives at a position just in front of the fixing roller 151, the surface temperature of the fixing roller 151 is reduced to 145 degrees C. (t2). The surface temperature of the fixing roller 151 remains reduced at 145 degrees C. until the leading end of the paper reaches the fixing roller 151 (t3) and the front end of the paper passes the fixing roller 151 (t4). Therefore, the moisture content of the front end portion of the paper is not excessively vaporized because the amount of heat received by the front end of the paper is reduced. Accordingly, curling is reduced at the front end portion of the paper.

During the passage of the leading half of the paper past the fixing roller 151, the surface temperature of the fixing roller 151 is regulated to the normal fixing temperature (150 degrees C.) (t4~t5). However, during the passage of the trailing half of the paper past the fixing roller 151, the surface temperature of the fixing roller 151 is elevated to 155 degrees C. (t5~t6). The temperature drop in the pressure roller 152 induced by the absorption of heat by the paper and toner is suppressed because the temperature, i.e., the amount of heat, received by the pressure roller 152 and fixing roller 151 is raised. Accordingly, the total amount of heat which the leading half of the paper receives from the fixing roller 151 and the pressure roller 152 is equal to the total amount of heat the trailing half of the paper receives from the fixing roller 151 and the pressure roller 152. Thus, the toner is fused with a constant fixed strength along the entirety of the leading half and the trailing half of the paper.

During the passage of the trailing end of the paper past the fixing roller 151 (t6~t7), the surface temperature of the fixing roller 151 is reduced to 145 degrees C. Thus and therefore, excessive vaporization of the moisture content of the trailing end of the paper can be prevented by reducing the amount of heat received by the trailing end of the paper, thereby reducing the curl produced in the trailing end of the paper just as was accomplished for the leading end of the paper.

Figure 11:
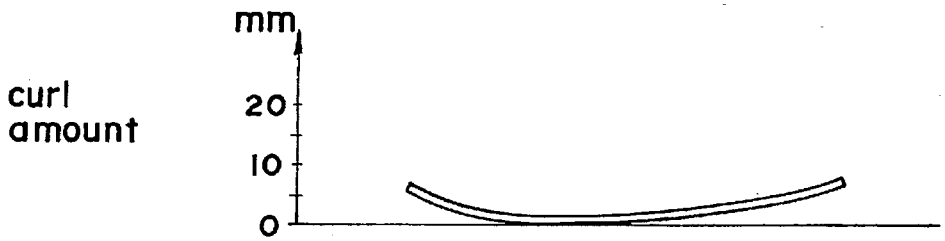
FIG. 11(*a*) is an illustration showing the paper curl produced by fixing via the fixing device of the first and second embodiments of the present invention.
Figure 11:
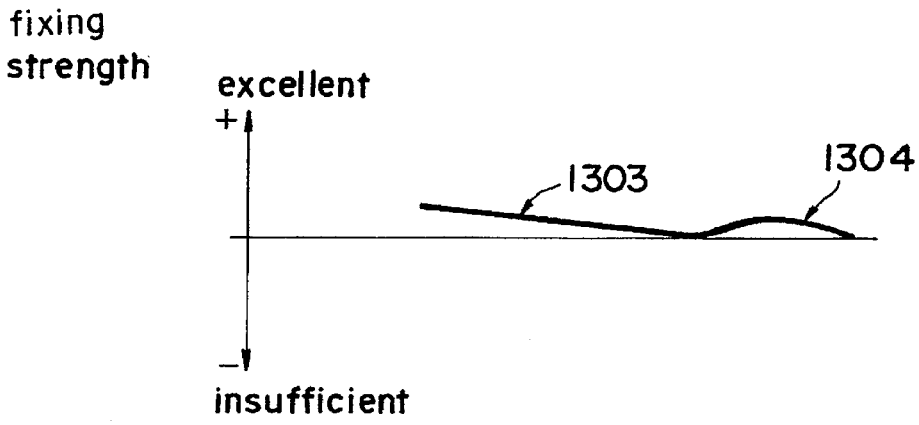

FIGS. 11(*a*) and 11(*b*) are illustrations showing the post-fixing curl and the toner fixed strength thereon achieved by the fixing device of the present embodiment.

FIG. 11(*a*) is an illustration showing a side view of the paper disposed on the base or the like, and further shows the amount of curl in the paper. As can be understood from this illustration, the leading end of the paper and the trailing end of the paper are separated only slightly from the base compared to a conventional sheet. That is, the amount of curl in the paper is reduced by the fixing device of the present embodiment.

Figure 24:
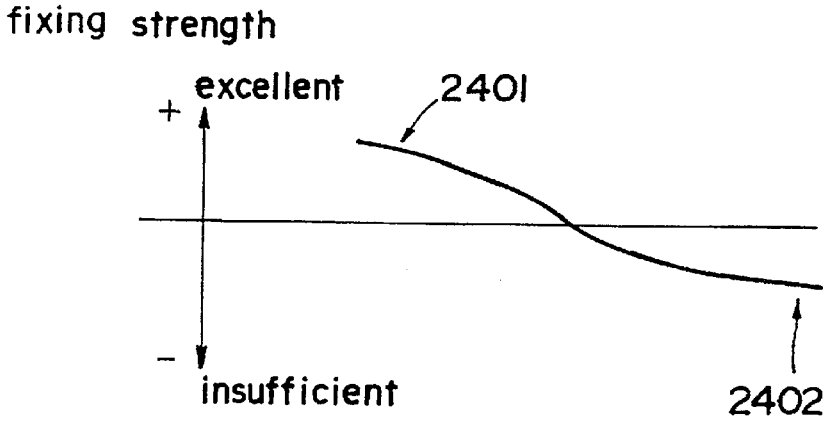
FIG.24 PRIOR ART
FIG. 24 is an illustration showing the fixed strength of the toner fixed via a conventional fixing device.
Figure 25:
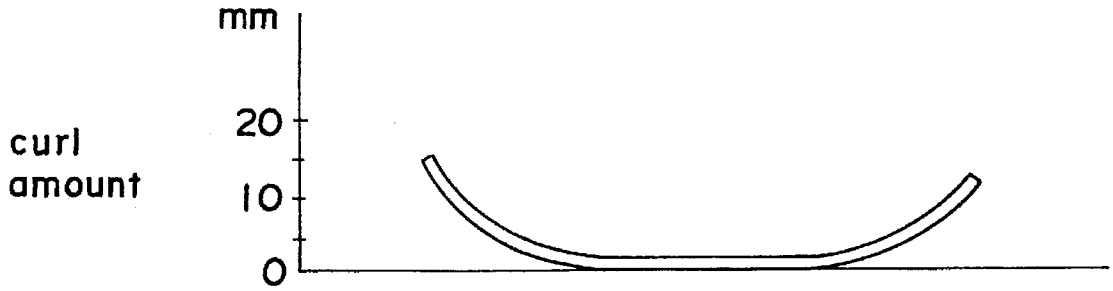
FIG. 25 PRIOR ART
Figure 26:
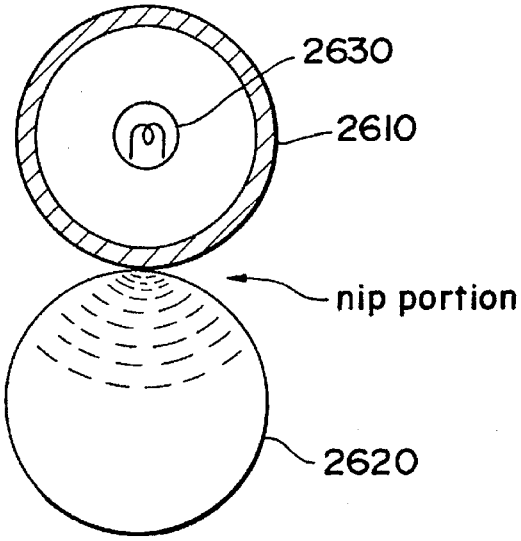
FIG. 26 PRIOR ART
FIG. 26 is an illustration showing a conventional fixing device.
Figure 28:
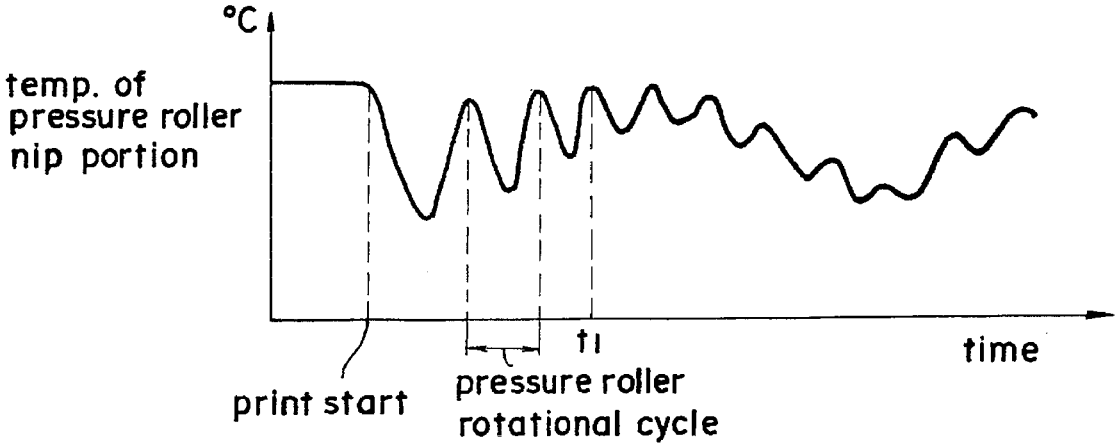
FIG. 28 PRIOR ART
FIG. 28 is an illustration showing the change in temperature of the nip portion in a conventional fixing device.
Figure 27:
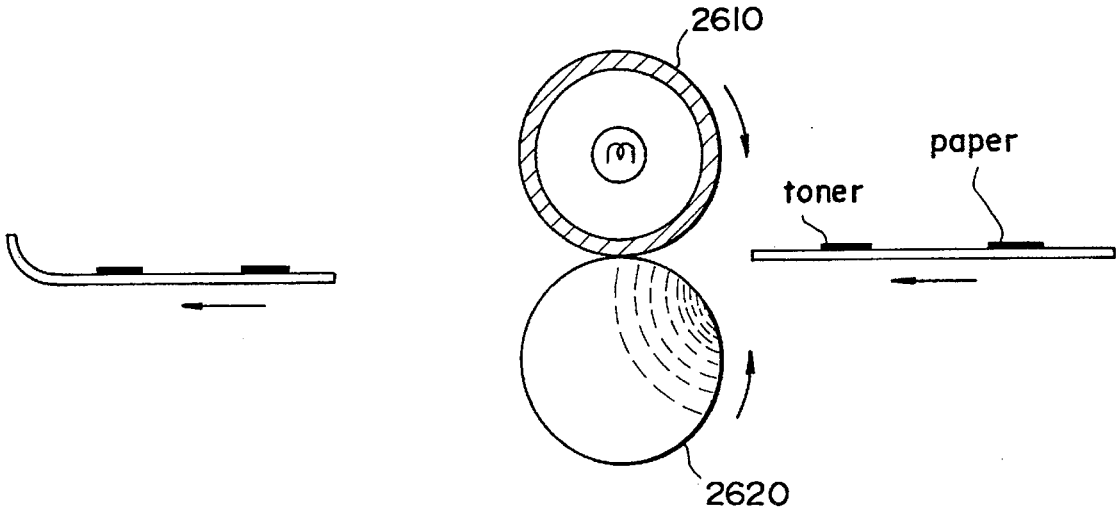
FIG. 27 PRIOR ART
FIG. 27 is an illustration showing paper and a conventional fixing device.

FIG. 11(*b*) is a graph showing the toner post-fixing fixed strength on a paper. The abscissa indicates the various positions of the paper in the transport direction. As is further confirmed by this illustration, the present embodiment provides that the fixed strength 1303 of the leading half of the paper and the fixed strength 1304 of the trailing half of the paper are substantially the same in comparison to the fixed strength achieved by a conventional fixing device as shown in FIG. 24. That is, superior fixing is accomplished along the entirety of the leading half and the trailing half of the paper by the fixing device of the present embodiment of the invention.

A second embodiment of the fixing device of the present invention is described hereinafter.

The construction of the fixing device of the second embodiment of the invention is identical to the construction of the fixing device of the first embodiment, with the exception of the temperature control method of the fixing roller 151. The points of difference of the second embodiment relative to the first embodiment of the fixing device of the present invention are the control target temperature setting process (step S405) and the temperature control process (step S406) of the main flow chart of FIG. 4. The processes of these subroutines differ from the corresponding processes of the first embodiment is that the surface temperature of the fixing roller 151 is regulated by forcibly controlling the ON and OFF switching of the heater 153 besides the feedback control. The subroutines of the aforesaid processes form the core of the description below.

Figure 8A:
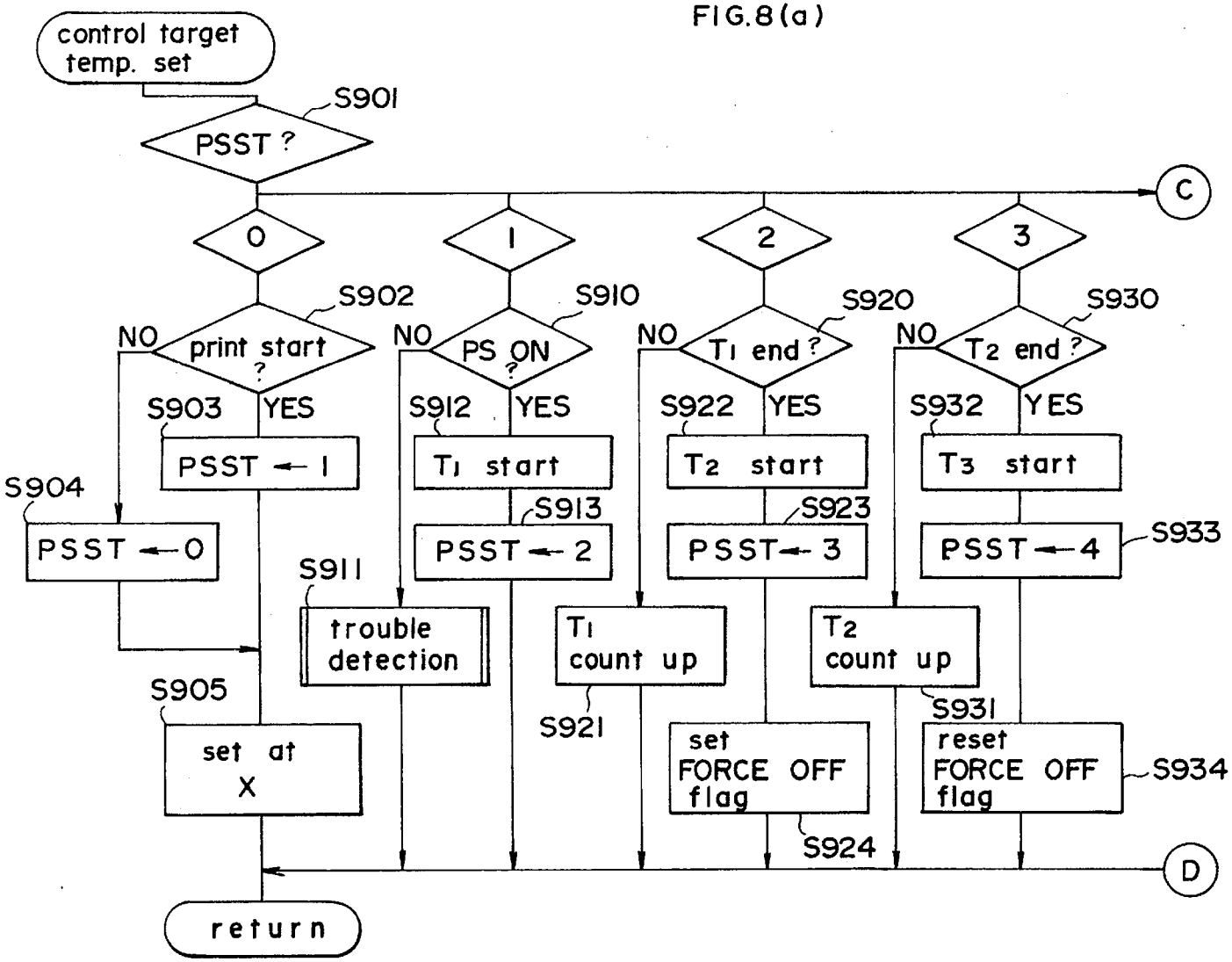
FIG. 8(*a*) and FIG. 8(*b*) are the subroutine showing the control target temperature setting process of the fixing device of the second embodiment of the invention.
Figure 8B:
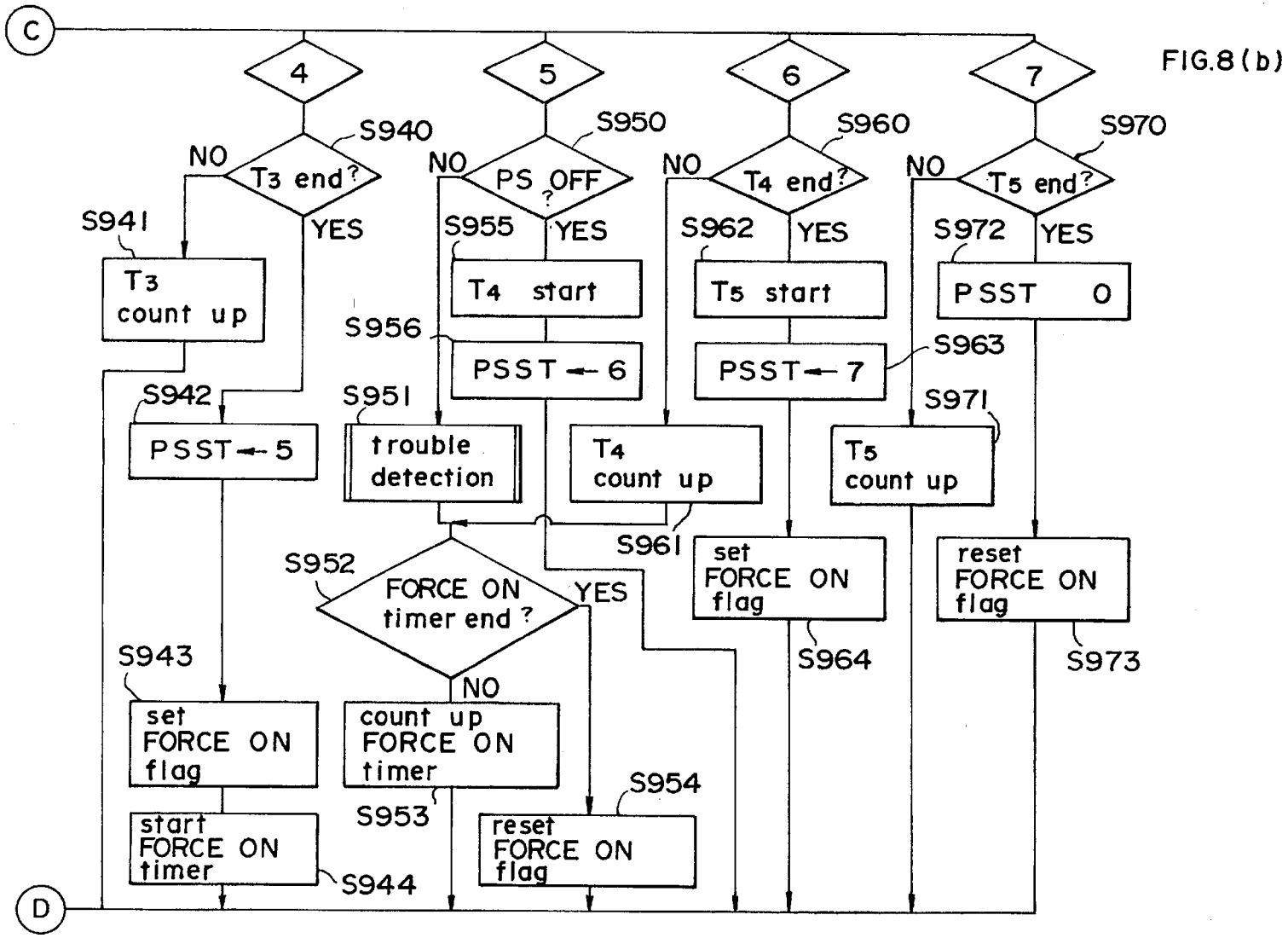

FIGS. 8(*a*) and 8(*b*) show the subroutine of the control target temperature setting process of step S405 of the main flow chart of FIG. 4. The variables used in the aforesaid subroutine are described below. The status PSST expresses the positional relationship between the paper and the fixing device 150. The value of the control target temperature is set via the status PSST value (0~7). The timers T1, T2, T3, T4, and T5 are set at variables incremented via the status PSST value and the like. X is a constant expressing the control target temperature of the surface of the fixing roller 151, e.g., X=150 degrees C. This subroutine is described more fully below.

First, the control circuit 20 determines in step S901 which, if any, process shall be executed via the status PSST value. When this subroutine starts, the status PSST value remains set at [0] (initial value). Thus, the processes of step S902 and subsequent steps are executed. The processes of steps S902~905 are identical to the steps S602~605 of FIG. 6. That is, in step S902, a check is made to determine whether or not a print operation has started, and if a print operation is not on-going, [0] is assigned for the status PSST value (step S904). On the other hand, if a print operation has started, [1]is assigned for the status PSST value (step S903).

Then, the control target temperature is set at the normal fixing temperature X (150 degrees C.) (step S905), whereupon the subroutine returns to the main flow chart of FIG. 4. Next, the heater is controlled so as to have the surface temperature of the fixing roller 151 coincide with the control target temperature X (150 degrees C.) (step S406). Accordingly, when a print operation starts, the surface temperature of the fixing roller 151 is regulated to 150 degrees C., and the temperature of the pressure roller 152 is also elevated through its contact with said fixing roller 151.

When processing jumps from the main flow chart to the aforesaid subroutine, the status PSST value is set at [1]. Therefore, step S910 and subsequent steps are executed. The CPU 21 determines whether or not the paper sensor 24 is turned ON, i.e., whether or not the leading end of the paper discharged from the image forming cartridge 130 has arrived at the paper sensor 24 disposed proximately to the fixing device 150 (step S910). When the paper sensor 24 is in the OFF state because the leading end of the paper has not yet reached said paper sensor 24 (step S910: NO), the trouble detector timer is started (step S911), and the subroutine returns to the main flow chart. Then, if the paper sensor 24 has not turned ON after an predetermined period has elapsed even if the trouble detector timer has reached a predetermined value (step S910: NO), a paper jam or the like is assumed to have occurred and the error display process and the like are executed.

On the other hand, when the paper sensor 24 is turned ON in step S910 because the leading end of the paper has reached said paper sensor 24, the timer T1 counting operation is started (step S912). Then, the status PSST value is set at [2] (step S913), and the subroutine returns to the main flow chart. The state at this time is shown in FIG. 7(1). As shown in FIG. 7(1), the paper sensor 24 is turned ON by the arrival of the leading edge of the paper with toner adhered thereon at the position of the sensor 24 disposed in front of the fixing roller 151. The processes of steps S910~913 are identical to the processes of steps S610~613 of FIG. 6.

Then, whenever the aforesaid subroutine is executed, step S920 is executed because the status PSST value is set at [2]. In step S920, a determination is made as to whether or not the timer T1 which was previously started has reached a predetermined value, i.e., whether or not the leading end of the paper has past the paper sensor 24 and arrived in proximity to the fixing roller 151. When the timer T1 counting operation is not yet completed because the leading end of the paper has not arrived in proximity to the fixing roller 151 (step S920: NO), the timer T1 is incremented (step S921), and thereafter the subroutine returns to the main flow chart.

On the other hand, when the timer T1 counting operation is completed in step S920 because the leading end of the paper has arrived at the fixing roller 151, the timer T2 counting operation is started (step S922), and the status PSST value is set at [3] (step S923). Then, the FORCE OFF flag is set (step S924), and the subroutine returns to the main flow chart. The heater 153 is forcibly turned OFF in the temperature control process of the main flow chart (step S406 of FIG. 4). Thus, the surface temperature of the fixing roller 151 is reduced to less than 150 degrees C. The paper position at this time is shown in FIG. 7(2). When the leading end of the paper arrives in front of the fixing roller 151, the surface temperature of said fixing roller 151 has been reduced.

Then, whenever this subroutine is executed, step S930 is executed because the status PSST value is set at [3]. In step S930, a determination is made as to whether or not the timer T2 which was previously started has reached a predetermined value, i.e., whether or not the leading end of the paper has past the fixing roller 151. When the result of said determination is NO, the timer T2 is incremented (step S931), and the subroutine returns to the main flow chart. Thus, fixing is accomplished on the leading end portion of the paper at a fixing temperature X1 (145 degrees C.) which is less than the normal fixing temperature X. Curling is reduced in the leading end portion of the paper because of the lesser amount of heat applied thereto.

When the timer T2 counting operation is completed in step S930 because the leading end of the paper has past the fixing roller 151, the timer T3 counting operation is started (step S932), and the status PSST value is set at [4] (step S933). After the FORCE OFF flag is reset (step S934), the subroutine returns to the main flow chart. In the main flow chart, feedback control is executed to regulate the surface temperature of the fixing roller 151 so as to coincide with the control target temperature (150 degrees C.) because the FORCE OFF flag has been reset (step S406 of FIG. 4). That is, during the time after the leading end of the paper has past the fixing roller 151 and until the leading half of the paper passes the fixing roller 151, the surface temperature of the fixing roller 151 is regulated to 150 degrees C. The paper position at this time is shown in FIG. 7(3).

When the aforesaid subroutine is executed, step S940 is executed because the status PSST value is set at [4]. In step S940, a determination is made as to whether or not the timer T3 which was previously started has reached a predetermined value, i.e., whether or not the leading half of the paper has past the fixing roller 151. When the leading half of the paper has not completed passage past the fixing roller 151 (step S940: NO), the timer T3 is incremented (step S941), and thereafter the subroutine returns to the main flow chart. Thus, the fixing of the leading half of the paper is accomplished at the normal fixing temperature X (150 degrees C.).

When, however, the leading half of the paper has completed passage past the fixing roller 151 and the center portion of the paper has arrived at the fixing roller 151, the timer T3 counting operation ends. At this time, the result of the determination in step S940 is YES, and the status PSST value is set at [5] (step S942). Then, the FORCE ON flag is set (step S943), the FORCE ON timer counting operation is started (step S944), and thereafter the subroutine returns to the main flow chart. In this way, the heater 153 remains in the ON state until the FORCE ON timer reaches a predetermined value. Accordingly, the temperature of the fixing roller 151 exceeds 150 degrees C. The paper position at this time is shown in FIG. 7(4).

During the passage of the trailing half of the paper past the fixing roller 151, the temperature of the fixing roller 151 is elevated above 150 degrees C. Therefore, the temperature, i.e., the amount of heat, received by the pressure roller 152 and fixing roller 151 is elevated. The heat from the pressure roller 152 is absorbed by the paper and toner, thereby suppressing the temperature drop of the pressure roller 152. Therefore, the total amount of heat received by the leading half of the paper and the total amount of heat received by the trailing half of the paper are equal, such that superior fixing is accomplished along the entirety of the leading half and the trailing half of the paper.

Then, when this subroutine is executed, step S950 is executed because the status PSST value is set at [5]. In step S950, a determination is made as to whether or not the paper sensor 24 is in the OFF state, i.e., whether or not the trailing end of the paper has past the paper sensor 24. If the result of this determination is NO, the trouble detector timer counting operation is started (step S951). Thereafter, when the paper sensor 24 is turned OFF, i.e., the trailing end of the paper has not past the paper sensor 24 after a predetermined period has elapsed even if the trouble detector timer has reached a predetermined value, a paper jam is assumed in the fixing device 150. In this instance, error display and like predetermined processes are executed.

When the determination is made as to whether or not the FORCE ON timer has reached a predetermined value (step S952) and the result of said determination is NO, the FORCE ON timer is incremented (step S953), and thereafter the subroutine returns to the main flow chart. On the other hand, when a predetermined time period has elapsed and the FORCE ON timer has reached a predetermined value (step S952: YES), the FORCE 0N flag is reset (step S954), and thereafter the subroutine returns to the main flow chart. During the time required for the FORCE ON timer to reach a predetermined value, the heater 153 is in the 0N state.

However, when the trailing end of the paper has past the paper sensor 24, the determination in step S950 is YES. Then, the timer T4 counting operation is started (step S952), the status PSST value is set at [6] (step S956), and thereafter the subroutine returns to the main flow chart. The paper position at this time is shown in FIG. 7(5).

Then, when the aforesaid subroutine is executed, step S960 is executed because the status PSST value is set at [6]. In step S960, a determination is made as to whether or not the timer T4 which was previously started has reached a predetermined value, i.e., whether or not the trailing end of the paper has passed the fixing roller 151 after the elapse of a predetermined time from the passage of said paper past the paper sensor 24. If the trailing end of the paper has not reached the fixing roller 151 (step S960: NO), the timer T4 is incremented (step S961), and thereafter the processes of steps S952~954 are executed. That is, it is determined that the FORCE ON timer has reached a predetermined value and the FORCE ON flag is reset. Thereafter, the subroutine returns to the main flow chart.

When, on the other hand, in step S960 the timer T4 reaches a predetermined value and the trailing end of the paper has entered in the fixing roller 151 as shown in FIG. 7(6), the timer T5 counting operation is started (step S962), and the status PSST value is set at [7] (step S963). Then, the FORCE OFF flag is set (step S964), and thereafter the subroutine returns to the main flow chart. In the main flow chart, the surface temperature is reduced because the heater 153 is forcibly turned OFF.

Therefore, the surface temperature of the fixing roller 151 is reduced during the passage of the trailing end of the paper past the fixing roller 151. Therefore, the amount of heat received from the fixing roller 151 and the pressure roller 152 is less than that received by the leading half and the trailing half of the paper, such that the moisture content of the trailing end of the paper is not excessively vaporized and curling of the trailing end of the paper is reduced.

When the aforesaid subroutine is executed, step S970 is executed because the status PSST value is set at [7]. In step S970, a determination is made as to whether or not the timer T5 which was previously started has reached a predetermined value, i.e., whether or not the trailing end of the paper has separated from the fixing roller 151. When the result if this determination is NO, the timer T5 is incremented (step S971), and thereafter the subroutine returns to the main flow chart.

On the other hand, in step S970, when the timer T5 reaches a predetermined value and the trailing end of the paper has separated from the fixing roller 151 as shown in FIG. 7(7), the status PSST value is returned to [0] (step S972). Then, the FORCE OFF flag is reset (step S973), and thereafter the subroutine returns to the main flow chart. The heater 153 is controlled so as to have the surface temperature of the fixing roller 151 coincide with the contort target temperature X (150 degrees C.) because the FORCE OFF flag has been reset.

Figure 9:
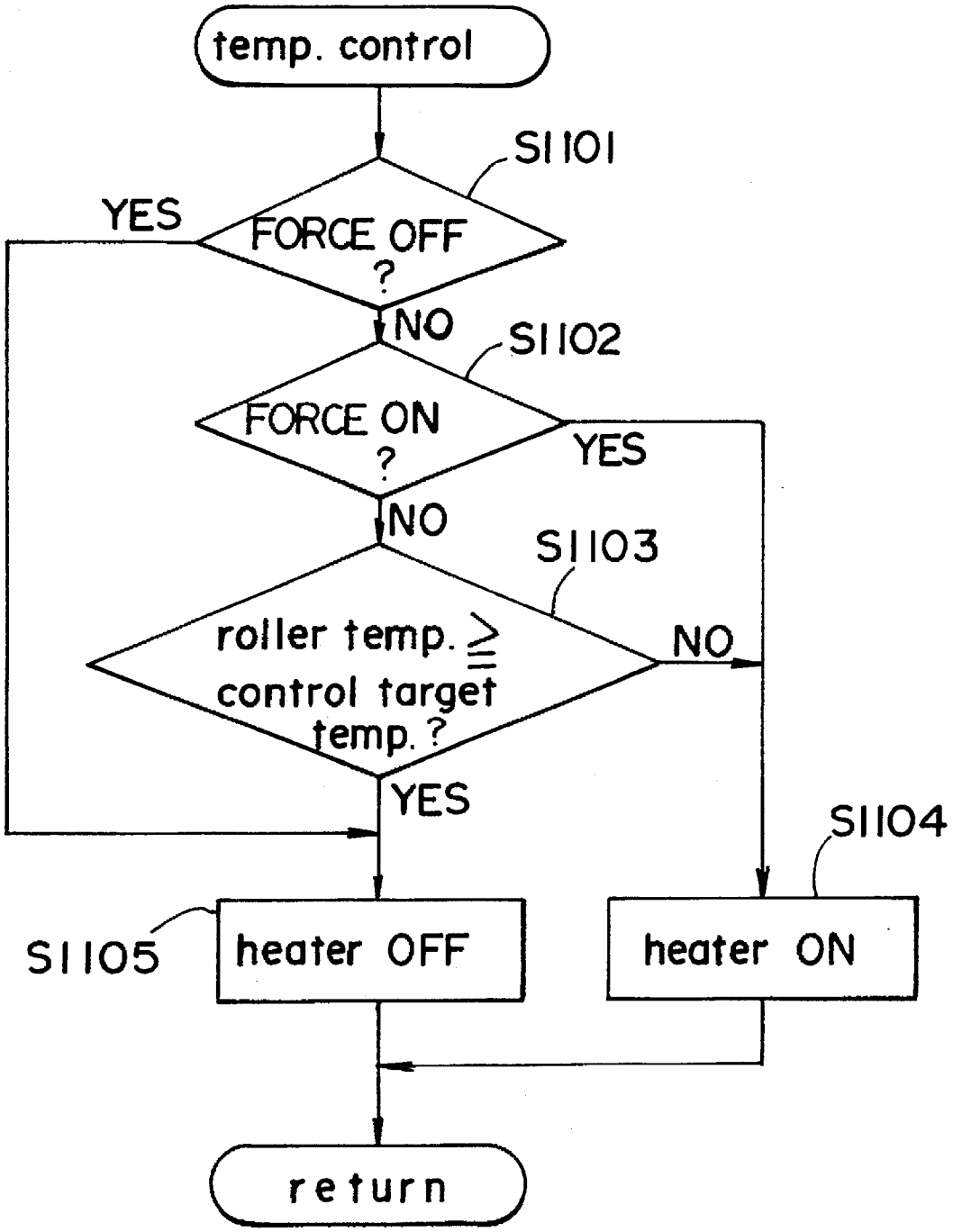
FIG. 9 is a subroutine showing the temperature control process of the fixing device of the second embodiment of the invention.

FIG. 9 shows the temperature control process subroutine of the main flow chart (step S406 in FIG. 4).

When this subroutine is executed, a determination is made as to whether or not the FORCE OFF flag has been reset (step S1101). If the FORCE OFF flag has been reset (step S1101: YES), the heater 153 is turned OFF (step S1105), and thereafter the subroutine returns to the main flow chart. If the FORCE OFF flag has not ben reset (step S1101: NO), a determination is made as to whether or not the FORCE ON flag has been reset (step S1102). If the FORCE ON flag has been reset (step S1102: YES), the heater 153 is turned ON (step S1104), and thereafter the subroutine returns to the main flow chart.

On the other hand, when the FORCE ON flag has been reset (step S1102: NO), the determination of step S1103 is executed. That is, a determination is made as to whether or not the surface temperature of the fixing roller 151 is equal to or greater than the control target temperature. If the result of the determination is YES, the heater 153 is turned OFF (step S1105), and thereafter the subroutine returns to the main flow chart. If, however, the surface temperature of the fixing roller 151 is less than the control target temperature (step S1103: NO), the heater is turned ON (step S1104), and thereafter the subroutine returns to the main flow chart. Thus, the surface temperature of the fixing roller 153 can be thereby regulated.

The results obtained by the fixing device of the second embodiment of the invention described above are identical to those results obtained by the first embodiment.

When controlling the heater 153, a feedforward control may be used to apply a voltage to the heater 153 based on predetermined data, without using a so-called feedback control. Furthermore, in consideration of the heat transmission time of the fixing roller 151, the timing for the ON/OFF switching of the heater 153 may be suitably varied. That is, when prolonging the heat transmission time to increase the amount of heat of the fixing roller 151, the delay of the control time can be reduced by speeding up the timing for the ON/OFF switching of the heater 153.

As previously described, the first and second embodiments of the present invention provide superior fixing of a paper along the entirety of the leading half portion in the transport direction and the trailing half portion in the transport direction. Furthermore, the amount of heat received by the leading end portion in the transport direction and the trailing half portion in the transport direction is reduced, so as to prevent curling of the paper by reducing moisture content vaporization.

Paper curl may also prevented by avoiding contact of the leading end portion of the paper with the high temperature area of the pressure roller when the paper is transported to the fixing device. Such a device is described below.

Figure 12:
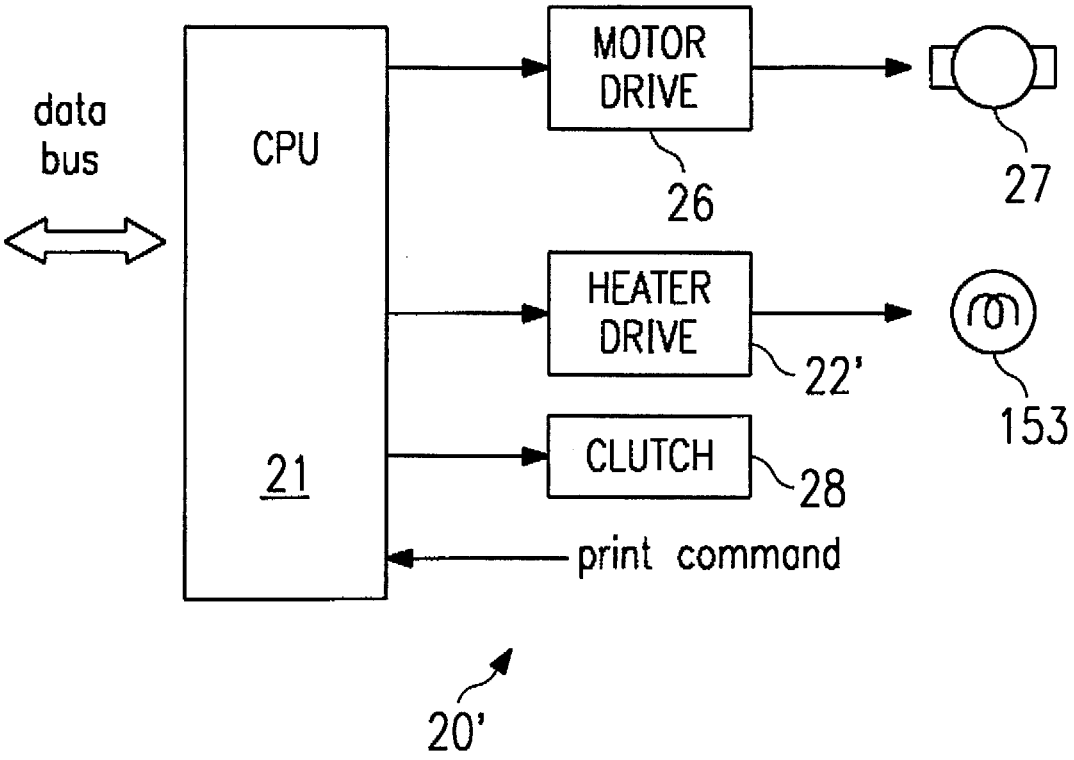
FIG. 12 is a block diagram of the control circuit of the fixing device of the third embodiment of the invention.
Figure 14:
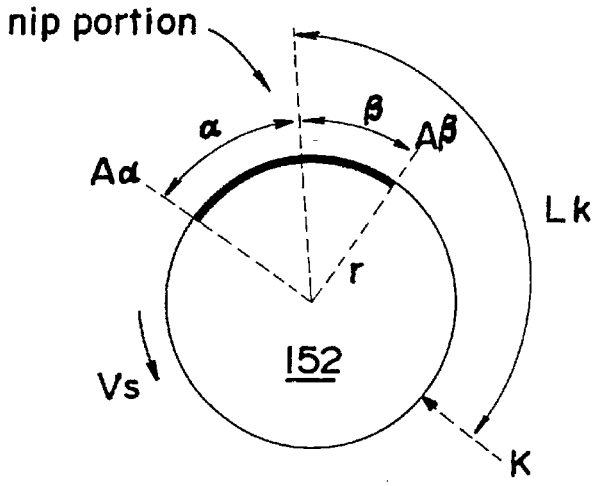
FIG. 14 is an illustration showing the high temperature area of the pressure roller of the third embodiment of the invention.

FIG. 12 is a block diagram showing the control circuit 20' of a laser printer using a third embodiment of the fixing device of the present invention. The construction of the laser printer is identical to that shown in FIG. 1, and details of said construction are therefore omitted herefrom. In FIG. 1 and the drawings explained hereinafter, like parts are designated by like reference numbers. In FIG. 14, the CPU 21, which is connected to the data bus, executes predetermined processes in accordance with operating sequences written in the program ROM.

The main motor 27 is a direct current (DC) motor which rotates the fixing roller 151, pressure roller 152, and feed roller 122 and the like. The drive of said main motor 27 is controlled via the main motor drive circuit 26. The heater drive circuit 22' drives the ON/OFF switching of the heater 153 arranged within the fixing roller 151. The heater drive circuit 22' operates in accordance with the output signals of the CPU 21, and controls the temperature of the fixing roller 151 to predetermined temperatures. The paper feed clutch 28 (paper feed means) is constructed so as to intermittently transmit the drive force of the main motor 27 to the rotating shafts of the feed roller 122 and the like, and comprises a solenoid and the like. When a sheet feed command is input to the CPU 21, the paper feed clutch 28 and main motor 27 are operated with predetermined timing.

Figure 13:
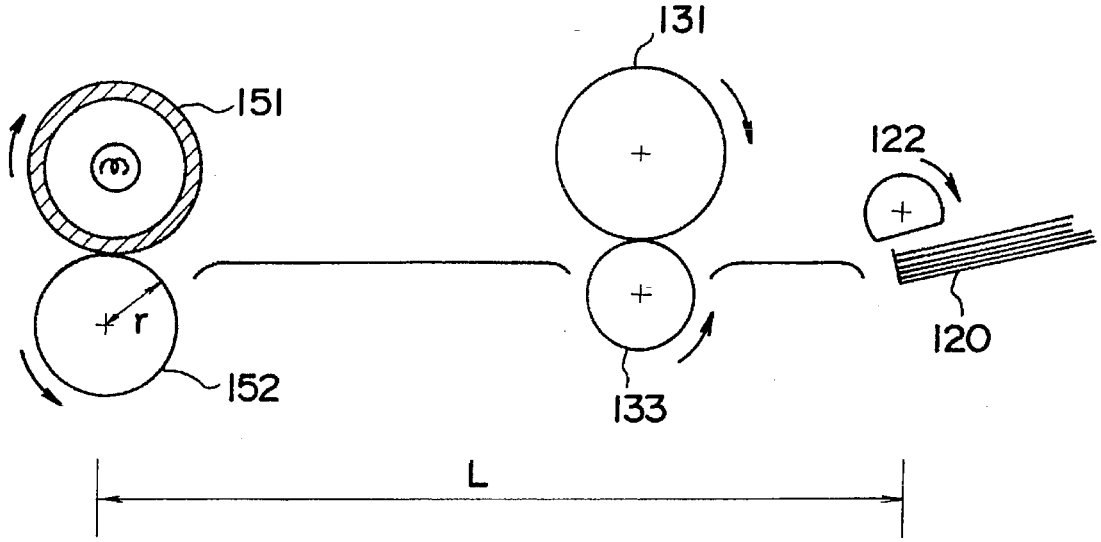
FIG. 13 is an illustration showing the paper feed path of the third embodiment of the invention.

FIG. 13 shows the paper transport path from the paper feed roller 122 to the fixing device 150.

The fixing device 150 is arranged at a position removed from the paper feed roller 122 by only a distance L. A photosensitive drum 131 and a transfer roller 133 are arranged within the paper feed path extending from the feed roller 122 to the fixing device 150. The feed roller 122, photosensitive drum 131, transfer roller 133, fixing roller 151, and pressure roller 152 are all rotatably driven by the main motor 27 in the directions indicated by the arrows in the drawing, and the circumferences of said members are constructed such that they rotate at a speed Vs. Therefore, the paper is transported from the feed roller 122 to the fixing device 150 at speed Vs (called the system speed Vs).

When the main motor 27 is turned on during printing operations in the fixing device of the aforesaid construction, the rotation of said main motor 27 enters the routine state after a predetermined time has elapsed. Therefore, a predetermined time is required for the rotation speed of the pressure roller 152 to accelerate from zero to Vs. The control circuit 20' turns ON the aforesaid paper feed clutch 28 with a predetermined timing, thereby rotating the paper feed roller 122. The feed roller 122 starts rotation simultaneously with the turning ON of the paper feed clutch 28 after the main motor 27 enters the normal state, thereby greatly reducing the time for the rotation speed of the feed roller 122 to attain the system speed Vs, such that said time may be ignored. Thus, the paper accommodated in the paper supply tray 120 is transported via the feed roller 122 at a system speed Vs to the nip portion of the photosensitive drum 131 and the transfer roller 133, whereupon the toner image is transferred. This paper is then transported at a system speed Vs to the nip portion of the fixing roller 151 and pressure roller 152, whereupon the toner image is thermally fixed onto said paper. In the present embodiment, the paper transport timing is controlled so as not to allow the leading end of the paper to make contact with the high temperature area of the pressure roller 152.

The operation of the fixing device of the third embodiment of the invention is described hereinafter.

Figure 15:
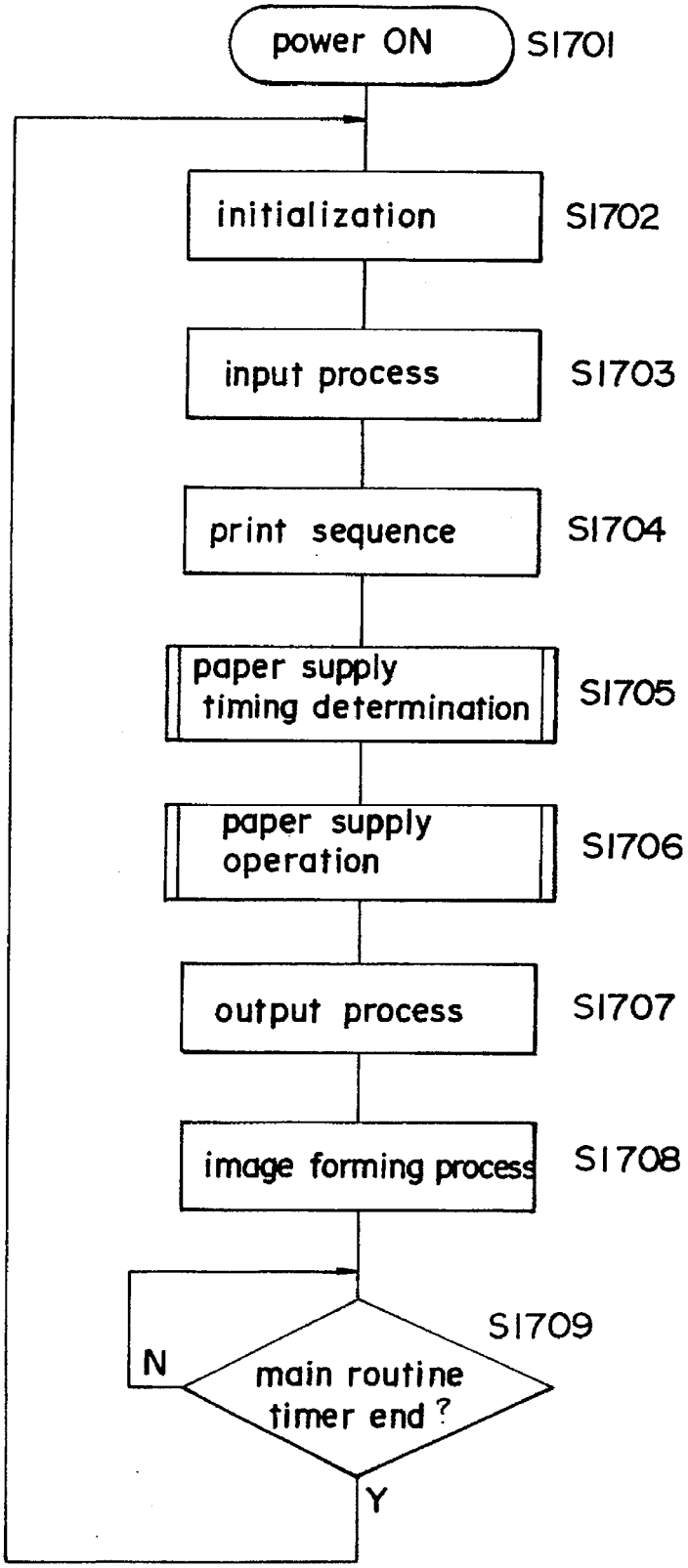
FIG. 15 is a main flow chart showing the operation of the fixing device of the third embodiment of the invention.

FIG. 15 is a main flow chart showing the operation of the fixing device of the present embodiment. When an operator turns on the power to the laser printer (step S1701), the CPU 21 of the control circuit 20' initializes the values of all internal registers and the like (step S1702). At the same time, the main routine timer counting operation is started to determine the execution cycle of the main flow chart. The CPU 21 receives data from the operation panel and the like via the bus (step S1703). Thereafter, the control means 20 controls the operations of the image forming cartridge 130, optical unit 140 and the like (step S1704). At this time a determination is made as to whether or not mechanical trouble is present in the laser printer.

In step S1705, the paper supply timing (possible or impossible) is determined. That is, the supply of the paper is hypothesized this time, and the position of the high temperature area of the pressure roller 152 is calculated for when the leading end of the paper reaches the nip portion of the fixing device 150. Then, the paper feeding is prohibited when the high temperature area of the pressure roller 152 is positioned at the nip portion, whereas paper feeding is permitted at other times.

The paper feeding operation is executed in accordance with the aforesaid determination (step S1706). In other words, paper feeding starts only when the determination permits paper feeding in step S1706. Thereafter, the CPU 21 executes predetermined input and output operations via the bus and I/O ports and the like (step S1707, S1708). When the main routine timer attains a predetermined value (step S1709: YES), the subroutine returns to step S1703, and main flow chart is repeated.

Figure 16:
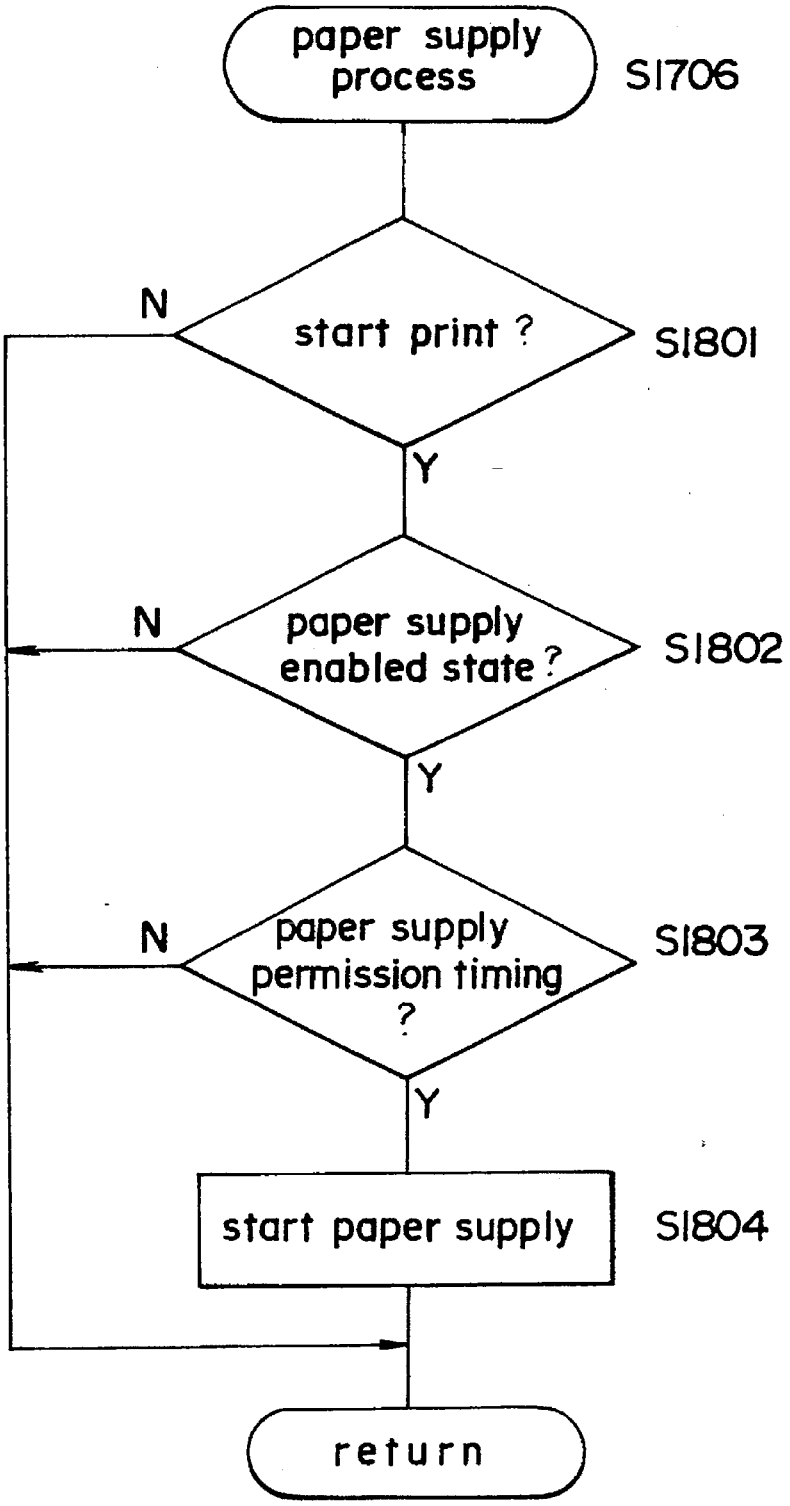
FIG. 16 is a subroutine showing the paper feeding process of the fixing device of the third embodiment of the invention.

FIG. 16 shows the paper supply process subroutine of step S1706. First, a determination is made as to whether or not the laser printer is currently printing, i.e., whether or not the CPU 21 has received a print command (step S1801). If the result of the determination is NO, the subroutine returns to the main flow chart. However, if the CPU 21 has received a print command (step S1801: YES), the processes of step S1802 and subsequent steps are executed.

In step S1802, a determination is made as to whether or not the laser printer is in the paper supply enabled state. For example, when mechanical trouble is detected in the aforesaid print sequence process (step S1704), it is determined that paper supply is impossible (step S1802: NO), and the subroutine returns to the main flow chart. On the other hand, if mechanical trouble has not occurred (step S1802: YES), the subroutine continues and the process of step S1803 is executed.

When the determination in step S1803 is that paper supply is possible in the paper supply timing determination of step S1705 (step S1803: YES), the paper supply clutch 25 is turned ON to start the paper supply operation (step S1804). However, when the determination in the paper supply process prohibits paper supply (step S1803: NO), the subroutine returns to the main flow chart without starting paper supply.

Before continuing the description of the paper supply timing process (step S1705 of the subroutine) of the main flow chart, the high temperature area of the pressure roller 152 is defined with reference to FIG. 14. As previously described, the high temperature area is the area of the pressure roller 152 which becomes high in temperature via the stopping of the fixing roller 151 during the standby period. During standby, the position separated a distance $\alpha$ from the nip in the transport direction is called the high temperature front end $A\alpha$, and the position separated a distance $\beta$ from the nip in a direction opposite the transport direction is called the high temperature back end $A\beta$. The area from the high temperature front end $A\alpha$ to the high temperature back end $A\beta$ is the high temperature area. The delay in the timing by which the paper arrives at the nip portion occurs due to slipping when the paper is transported. The area of high temperature of the pressure roller 152 may broaden in the transport direction, such that $\alpha \geqq \beta$.

Suppose the leading end of the paper arrives at the nip portion when a predetermined position of the pressure roller moves to the nip portion when the paper supply operation starts. A predetermined position on the pressure roller 152 is called the synchronizing position K. The distance on the surface of the pressure roller 152 from the synchronizing position K to the nip portion is defined as Lk. The transport distance L from the feed roller 122 to the fixing device 150 is expressed by the relationship $L=2\pi r+m+Lk$. In this expression, m expresses the number of rotations of the pressure roller 122 during the time period after the start of paper supply until the paper arrives at the nip portion; r expresses the radius of the pressure roller 122.

Figure 17:
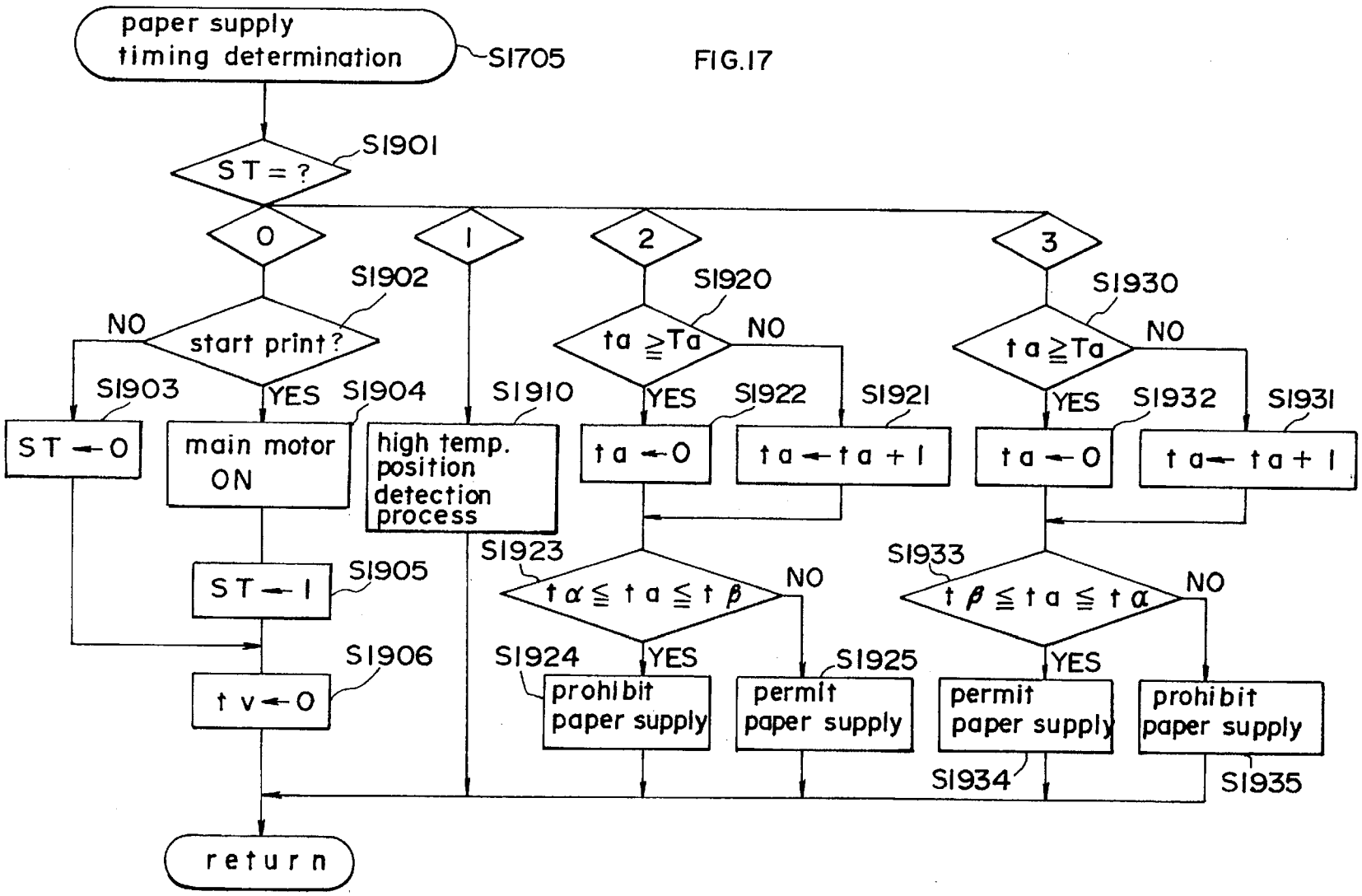
FIG. 17 is a subroutine showing the paper feed discrimination process of the fixing device of the third embodiment of the invention.
Figure 18:
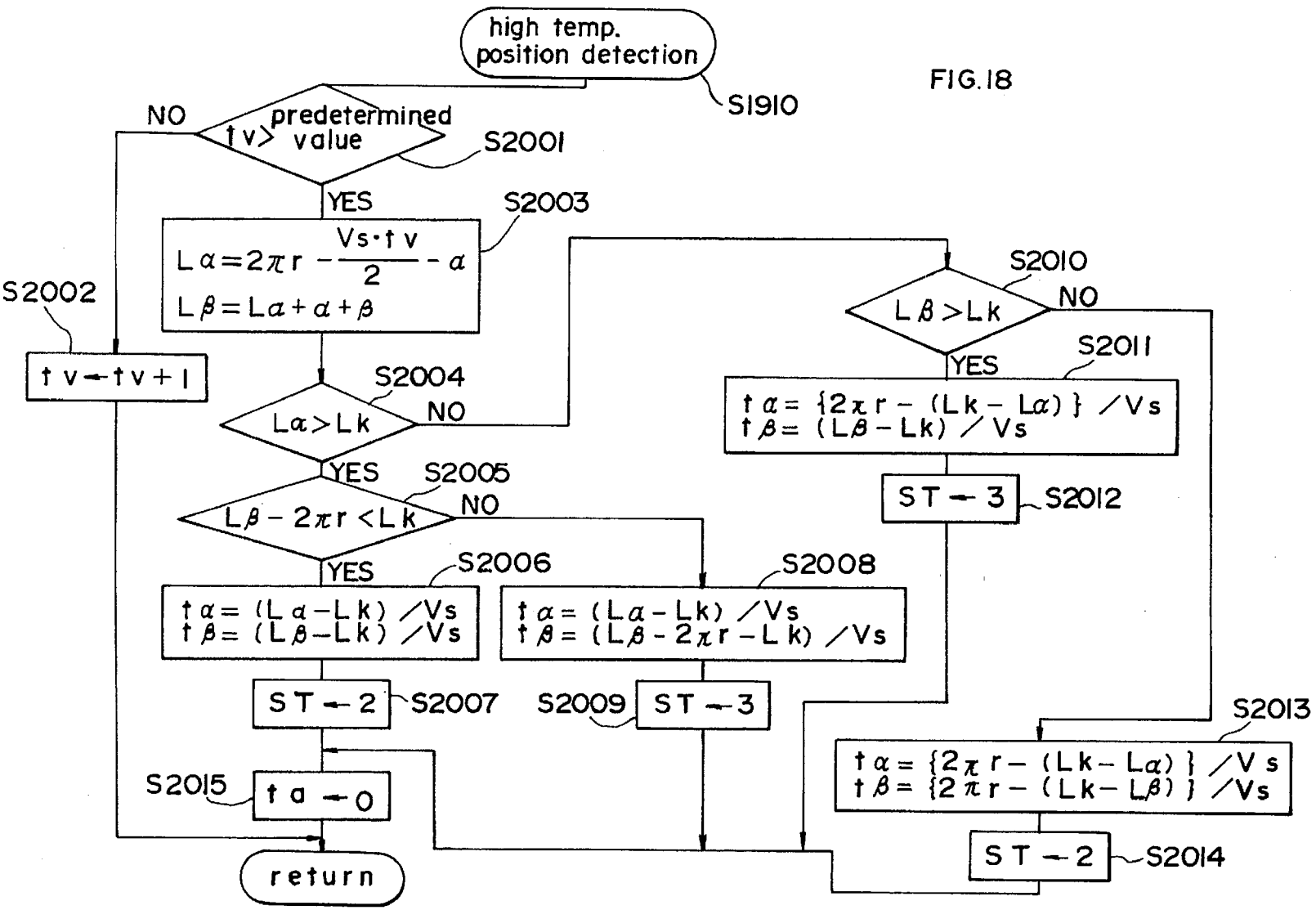
FIG. 18 is a subroutine showing the high temperature area position detection process of the fixing device of the third embodiment of the invention.

The paper supply timing subroutine shown in FIGS. 17 and 18 is described hereinafter.

When the routine jumps from the main flow chart to the aforesaid subroutine, the status PSST value is checked (step S1901). At this time, the status PSST value is [0] because it is in the initialized state. Thus, the processes of step S1902 and subsequent processes are executed.

In step S1902, a check is made to determine whether or not printing has started, i.e., whether or not the CPU 21 has received a print command. If the CPU 21 has not received a print command (step S1902: NO), the status PSST is maintained at the initialization value [0] (step S1903). However, if the print command has been received by the CPU 21 (step S1902: YES), the main motor 27 is actuated (step S1904), and the status PSST value is set at [1] (step S1905). That is, the CPU 21 starts rotation of the main motor 27 via predetermined signals output to the main motor drive circuit 26, so as to actuate the photosensitive drum 131, pressure roller 152 and the like.

Since a predetermined time is required for the main motor 27 to attain the normal state, a similar predetermined time is required for the rotational speed of the pressure roller 152 to attain the system speed Vs. The time required for the main motor 27 to attain the normal state is estimated beforehand and designated tv. Thus, the time period for the pressure roller 152 rotational speed to attain the system speed Vs can be determined using a timer tv in conjunction with the aforesaid value tv.

The timer tv is initialized at the same time as the main motor 27 starts rotation (step S1906), and the subroutine returns to the main flow chart. Then, when the routine again jumps to this subroutine, the processes described below are executed in accordance with the status PA value. In other words, if the CPU 21 has not received a print command, the processes of step S1902 and subsequent steps are executed because the status PSST value remains [0]. If, on the other hand, the CPU 21 does receive a print command, the status PSST value is set at [1] when the main motor 27 starts rotation. Therefore, the high temperature position detection process of step S1910 is executed. The high temperature position detection process subroutine is illustrated in FIG. 18.

In step S2001 of FIG. 18, a determination is made as to whether or not the timer tv has reached a predetermined value, i.e., whether or not the rotational speed of the pressure roller 152 has attained the system speed Vs. If the result of the determination is NO, the timer tv is incremented (step S2002), and thereafter the subroutine returns to the main flow chart of FIG. 15 via the subroutine of FIG. 17.

When the timer tv reaches a predetermined value, the rotational speed of the pressure roller 152 has attained the system speed Vs (step S2001: YES), the process of step S2003 is executed. In step S2003, the distance $L\alpha$ from the pressure roller 152 high temperature area front end $A\alpha$ to the nip portion, and the distance $L\beta$ from the high temperature area back end $A\beta$ to the nip portion are calculated, i.e., $L\alpha=2\pi r-(Vs\cdot tv/2)-\alpha$, $L\beta=L\alpha+\alpha+\beta$. The relationship $Vs\cdot tv/2$ expresses the distance rotated under acceleration on the circumference of the pressure roller 152. $L\alpha$ and $L\beta$ are shown in FIG. 9.

Based on the aforesaid calculated distances $L\alpha$ and $L\beta$, the times $t\alpha$ and $t\beta$ are calculated for the movement of the current high temperature area front end $A\alpha$ and the high temperature area back end $A\beta$, respectively, to the synchronizing position K. The times $t\alpha$ and $t\beta$ are calculated in the four cases described below by the relationship of the synchronizing position K and the high temperature areas.

Figure 19:
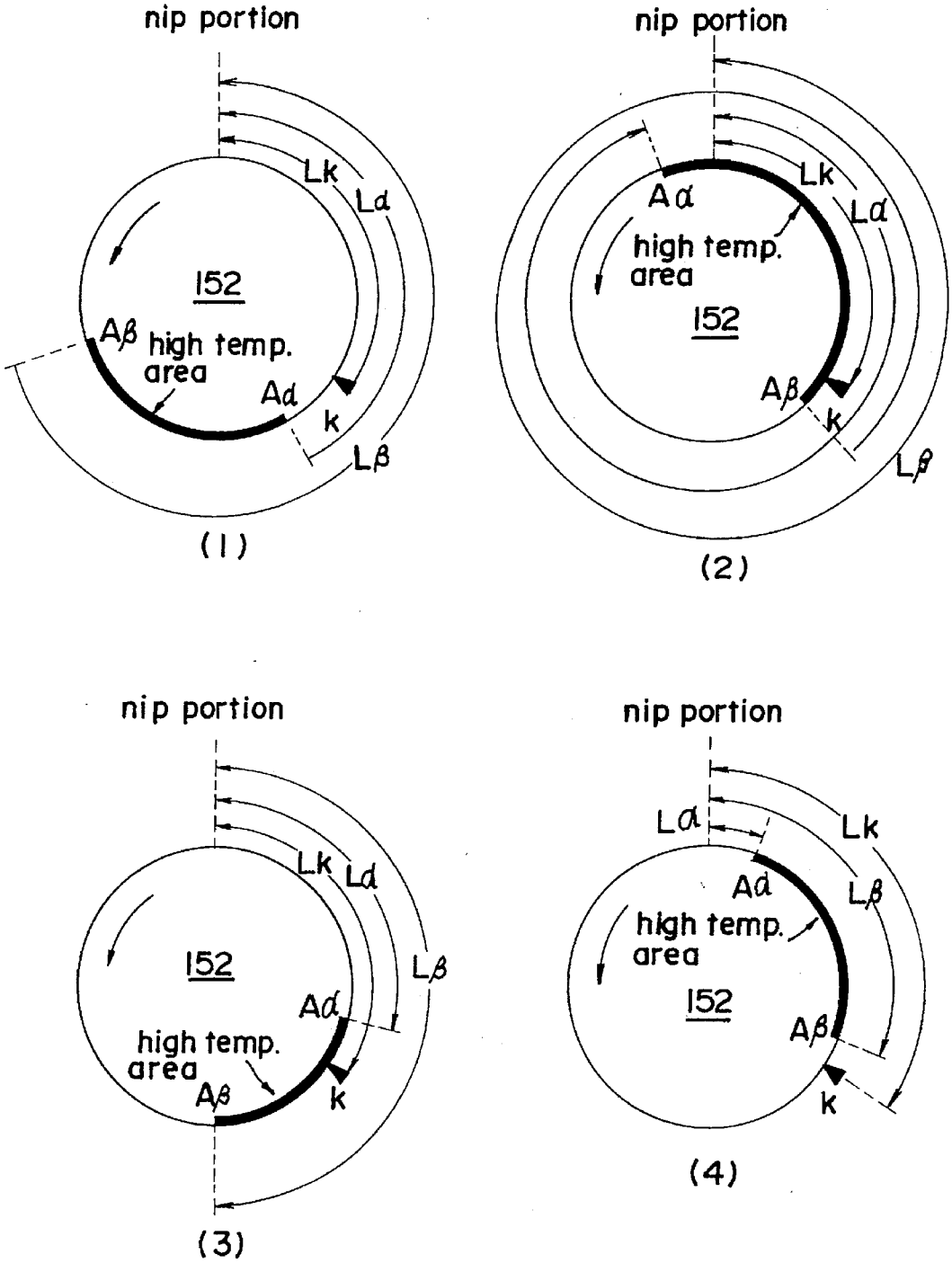
FIG. 19 is an illustration showing the high temperature area of the pressure roller and the synchronized position of the third embodiment of the invention.

Case 1: $L\alpha>Lk$ (step S2004: YES), $L\beta-2\pi r<Lk$ (step S2005: YES). As shown in FIG. 19(1), the pressure roller 152 high temperature area front end $A\alpha$ and high temperature area back end $A\beta$ are upstream from the synchronizing position K, i.e., these conditions are satisfied when the high temperature areas are not positioned at the synchronizing position. In this case, the respective times $t\alpha$ and $t\beta$ for moving the high temperature area front end $A\alpha$ and the high temperature area back end $A\beta$ to the synchronizing position K are calculated based on the calculation model of step S2006. In step S2006, $t\alpha$ and $t\beta$ are calculated via the equations $t\alpha=(L\alpha-Lk)/Vs$, and $t\beta=(L\beta-Lk)/Vs$. Then, the status PSST value is set at [2] (step S2007).

Case 2: $L\alpha>Lk$ (step S2004: YES), $L\beta-2\pi r\geqq Lk$ (step S2005: NO). As shown in FIG. 19(2), the pressure roller 152 high temperature area front end $A\alpha$ and the high temperature area back end $A\beta$ are upstream from the synchronizing position K, i.e., the high temperature area is positioned at the synchronizing position K. In this case, $t\alpha$ and $t\beta$ are determined in accordance with the calculation models of step S2008. The calculation models of step S2008 are $t\alpha=(L\alpha-Lk)/Vs$, $t\beta=(L\beta-2\pi r-Lk)/Vs$. After the pressure roller 152 starts rotation, the high temperature area back end $A\beta$ is rotated one or more rotations until the high temperature area front end $A\alpha$ arrives at the nip portion, such that $2\pi r$ of the aforesaid equation is subtracted. After $t\alpha$ and $t\beta$ are calculated as described above, the status PSST value is set at [3]. (step S2009)

Case 3: $L\alpha\leqq Lk$ (step S2004: NO), $L\beta>Lk$ (step S2010: YES). As shown in FIG. 19(3), the pressure roller 152 high temperature area back end $A\beta$ only is upstream from the synchronizing position K, i.e., the high temperature area is at the synchronizing position K. In this case, $t\alpha$ and $t\beta$ are calculated based on the calculation models of step S2012, $t\alpha=\{2\pi r-(Lk-L\alpha)\}/Vs$, $t\beta=(L\beta-Lk)/Vs$. Also in this case, the status PSST value is set at [3] (step S2012).

Case 4: $L\alpha\leqq Lk$ (step S2004: NO), $L\beta\leqq Lk$ (step S2010: NO). As shown in FIG. 19(4), the pressure roller 152 high temperature area front end $A\alpha$ and high temperature area back end $A\beta$ only are upstream from the synchronizing position K, i.e., the high temperature area is not positioned at the synchronizing position K. In this case, $t\alpha$ and $t\beta$ are calculated via the calculation model of step S2012, $t\alpha=\{2\pi r-(Lk-L\alpha)\}/Vs$, $t\beta=\{2\pi r-(Lk-L\beta)\}/VS$. Also in this case, the status PSST value is set at [2] (step S2012).

The calculated times $t\alpha$ and $t\beta$ are the times required for the high temperature area front end $A\alpha$ and the high temperature area back end $A\beta$ to sequentially arrive at the synchronizing position K at the current point in time (that moment at which the rotational speed of the pressure roller 152 attains the system speed Vs). When paper supply starts after the passage of time $t\alpha\sim t\beta$ (or $t\beta\sim t\alpha$) from the current point in time, the paper comes into contact with the high temperature area front end $A\alpha$ and the high temperature area back end $A\beta$. Thus, the leading end of the paper can be prevented from making contact with the high temperature area of the pressure roller 152 by starting the paper supply while avoiding the aforesaid time $t\alpha\sim t\beta$ (or $t\beta\sim t\alpha$).

Thereafter, the timer ta is initialized to [0] (step S2015), and the subroutine of FIG. 17 returns to the main flow chart of FIG. 15. The timer ta counting operation is executed after the rotational speed of the pressure roller 152 attains the system speed Vs. In subsequent processes (subroutine of FIG. 17), the timer ta determines whether or not paper supply is possible via comparison of the times $t\alpha$ and $t\beta$.

Then, when the routine jumps from the main flow chart to the paper supply timing subroutine of FIG. 17, processing is executed in accordance with the status PSST value set via the high temperature area position detection process (step S1910). As previously described, the status PSST value is determined by the relationship between the pressure roller 152 high temperature area position and the synchronizing position. That is, the status PSST value is set at [2] when the pressure roller 152 is in the positions shown in FIGS. 19(1) and 19(4), and the status PSST value is set at [3] when the pressure roller 152 is in the positions shown in FIGS. 19(2) and 19(3).

When the status PSST value is [2], the processes of step S1920 and subsequent steps are executed. First, a determination is made as to whether or not the timer ta has attains the rotational cycle Ta of the pressure roller 152 (step S1920). When the result of this determination is YES, the timer ta is reset because the pressure roller 152 is determined to have completed a cycle (step S1922). When the result of the determination is NO, however, the timer ta is incremented (step S1921).

The value of the timer ta is compared to the times tα and tβ calculated in the high temperature area detection process of step S1920 (step S1923). When the value of the timer ta is determined to be within the range of time tα~tβ (step S1923: YES), the paper supply starts, and after a time ta, the leading end of the paper is assumed to make contact with the high temperature area of the pressure roller 152. In this instance, paper supply is prohibited (step S1924). However, when the timer ta value is not within the range of time tα~tβ (step S1923: NO), the leading end of the paper cannot come into contact with the high temperature area of the pressure roller 152 even after paper supply is started. Thus, in this instance, paper supply is permitted (step S1925), and the subroutine returns to the main flow chart.

When the status PSST value is [3], the processes of step S1930 and subsequent steps are executed. The processes of steps S1930 to S1932 are executed in the same way as the processes of steps S1920 to S1922. That is, a determination is made as to whether or not the timer ta value has attained the rotational cycle Ta of pressure roller 152 (step S1930). If the result of this determination is YES, the timer ta is reset because the pressure roller 152 is found to have completed one cycle (step S1932). If the result of the determination is NO, however, the timer ta is incremented (step S1931).

Then, the timer ta value is compared to the times tα and tβ calculated in the high temperature area detection process of step S1920 (step S1933). When the timer ta value is determined to be within the range of time tβ~tα (step S1933: YES), paper supply is permitted (step S1934). On the other hand, when the timer ta value is not within the range of time tβ~tα (step S1933: NO), paper supply is prohibited (step S1935). Thereafter, the subroutine returns to the main flow chart.

In the main flow chart, paper supply is accomplished in accordance with the aforesaid paper supply timing determination (step S1706 of FIG. 15). Accordingly, after paper supply is started, when the leading end of the paper arrives at the nip portion of the fixing device 150, contact of the leading edge of the paper with the high temperature area of the pressure roller 152 can be avoided, thereby preventing curling of the leading end of the paper due to excessive heat.

Figure 20:
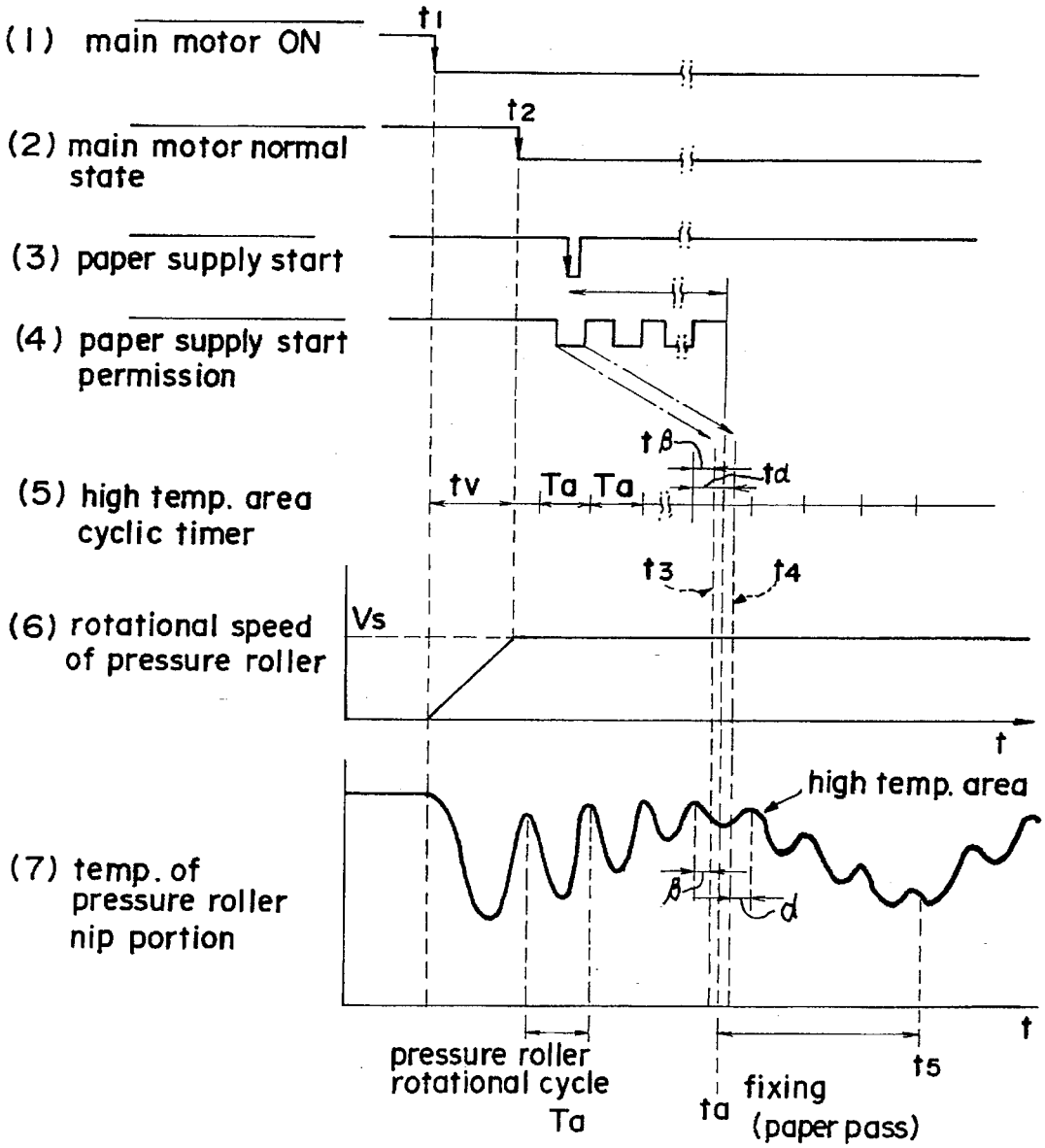
FIG. 20 is a timing chart showing the operation of the fixing device of the third embodiment of the invention.

FIG. 20 is a timing chart showing the operation timing of the fixing device of the present embodiment of the invention.

In the drawing, reference numeral (1) shows the control signal of the main motor drive circuit 26. This control signal is low level-active; a low level-active control signal causes the main motor to rotate. When the main motor 27 starts to rotate at the moment t1, the main motor 27 attains the normal state after a time tv has elapsed (moment t2), as shown in FIG. 20(2). FIG. 20(6) shows the rotational speed of the pressure roller 152 driven by the main motor 27. During the moments t1~t2, the rotational speed of the pressure roller 152 attains the system speed Vs.

Thereafter, the high temperature area of the pressure roller 152 heated by the fixing roller 151 is moved, such that the nip portion passes the high temperature area with each complete rotation of the pressure roller 152 (with each pressure roller rotation cycle Ta). The temperature change of the nip portion of the pressure roller 152 is shown in FIG. 20(7).

When the rotational speed of the pressure roller 152 attains the system speed Vs at the moment t2, the times tα and tβ are calculated by the CPU 21. As previously described, the times tα and tβ are the times wherein the high temperature area front end Aα and the high temperature area back end Aβ reach the synchronizing position K. For example, when the position of the high temperature area of the pressure roller 152 is that described in FIG. 19(2), paper supply is assumed possible because the high temperature area of the pressure roller 152 is not positioned at the nip portion during time tβ~tα (time t3~t4). That is, paper supply is possible during the time from moment t3 to moment t4. During the time from moment t3 to moment t4, the paper supply start permission signal is active (low level), as shown in FIG. 20(4). Thus, paper supply may start during the period when the paper supply start permission signal is active. The start of paper supply is accomplished by the fall of the paper supply start signal, as shown in FIG. 20(3).

Then, the paper supply clutch is turned ON, and the paper feed roller 122 starts to rotate. The leading end of the paper arrives at the fixing device 150 at a moment ta somewhere during the period between moment t3 to moment t4. At this time, the high temperature area of the pressure roller 152 is positioned so as to be removed from the nip portion, so as to avoid having the leading end of the paper come into contact with the high temperature area. Therefore, curling of the leading end of the paper through excessive heating can be avoided. Thereafter, the trailing end of the paper is separated from the nip portion (moment t5), and after fixing, the paper is discharged. The previously mentioned moment ta is determined by the timer ta which is reset each complete rotation of the pressure roller 152, as shown in FIG. 22(5).

Figure 21:
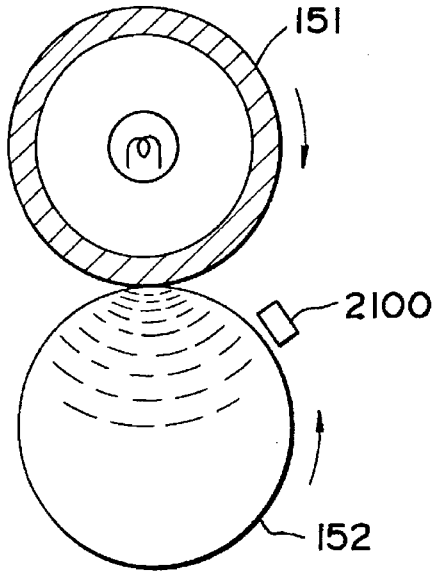
FIG. 21 is an illustration showing the fixing device of the fourth embodiment of the invention.

A fourth embodiment of the fixing device of the present invention is described hereinafter with reference to FIG. 21.

In the drawing, reference numeral 2100 refers to a thermistor disposed in proximity to the exterior surface of the pressure roller 152. The surface temperature of the pressure roller 152 is detected via the thermistor 2100. In the present fixing device, the moment the high temperature area of the pressure roller 152 passes the nip portion can be estimated based on the change in temperature of the pressure roller 152 detected by said thermistor 2100. That is, the temperature detected by the thermistor 2100 with each rotation of the pressure roller 152 has a peak which corresponds to the detection of the high temperature area. The timing for starting the paper supply can be controlled based on the moment of the appearance of the aforesaid peak, such that it is possible to avoid having the leading end of the paper come into contact with the high temperature area of the pressure roller 152. Accordingly, the efficacy of the fourth embodiment of the fixing device of the present invention is identical to that of the third embodiment.

Figure 22:
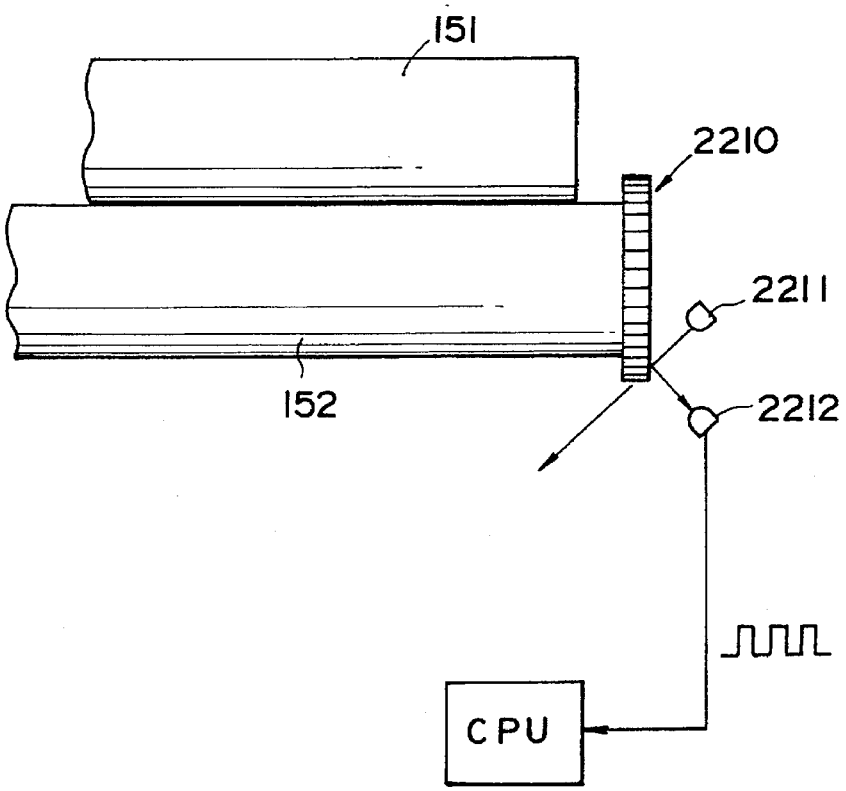
FIG. 22 is an illustration showing the fixing device of the fifth embodiment of the invention.
Figure 23:
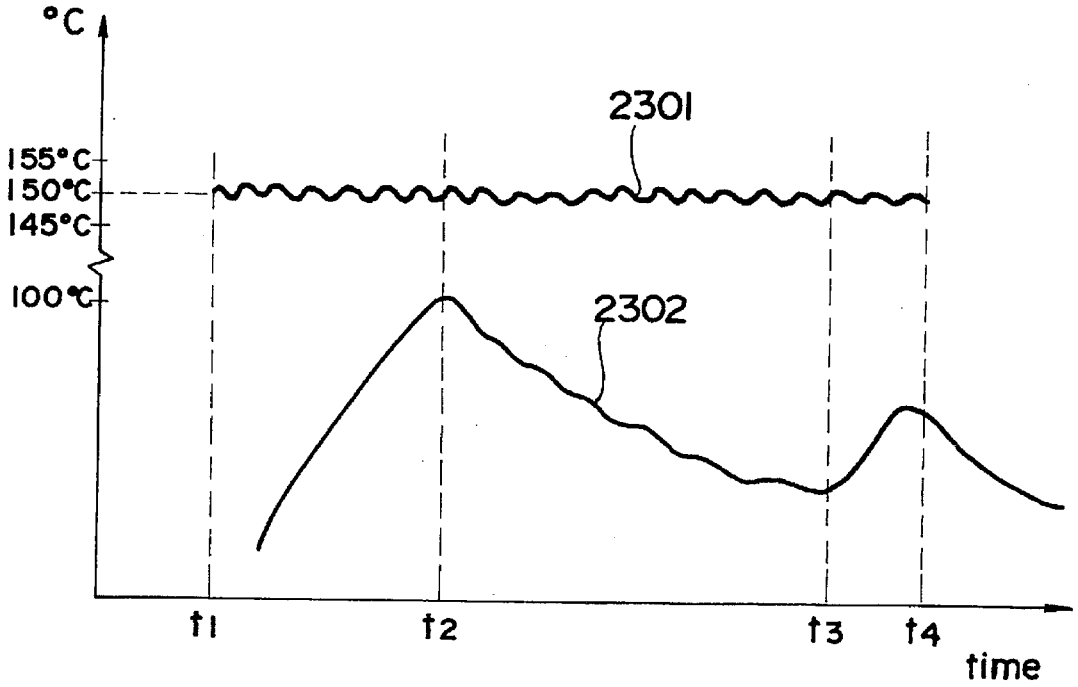
FIG.23 PRIOR ART
FIG. 23 is a graph showing the change in temperature of the fixing roller and the pressure roller of a conventional fixing device.

FIG. 22 shows a fifth embodiment of the fixing device of the present invention.

A gear 2210 is provided at one end of the pressure roller 152, In proximity to said gear 2210 are arranged a phototransistor 2212 and a photoemitter diode 2211 which count the teeth of said gear 2210. Light emitted from the photoemitter diode 2211 is reflected by the teeth of the gear 2210 and impinges the phototransistor 2212. When the pressure roller 152 rotates, the light emitted from the photoemitter diode 2211 is intermittently reflected by the teeth of the gear 2210 and impinges the phototransistor 2212. Thus, a pulse is output from the phototransistor 2212, and the position of the pressure roller 152 can be detected by counting said pulses.

Similar efficacy to that achieved by the third embodiment is therefore possible because the position of the high temperature area of the pressure roller 152 can be determined. A mark which reflects the emitted light may also be attached to a part of the gear 2210. In this instance, the position of the mark is detected by the phototransistor 2212, thereby allowing the position of the pressure roller 152 to be detected.

In the fixing devices of the third, fourth and fifth embodiments, a pulse motor may be used as the main motor. Therefore, the position of the pressure roller 152 may be detected by counting the pulses of said pulse motor. Such an arrangement would produce the previously mentioned effects (preventing paper curl) by allowing the position of the high temperature area of the pressure roller 152 to be readily detected.

When a fixing operation ends, or is stopped due to abnormal operation, the stopping position of the pressure roller may be controlled so as to avoid having the high temperature area of said pressure roller 152 positioned at the nip portion. In such an instance, heating over a plurality of rotations of only a specific location on the pressure roller 152 can be prevented. Thus, the temperature rise of the high temperature area of the pressure roller 152 can be relieved during standby, so as to avoid paper curl and the like.

Furthermore, contact of the leading end of the paper with the high temperature area of the pressure roller 152 can be prevented by controlling the time for starting rotation of the pressure roller 152 without controlling the paper supply timing (time for starting the rotation of the feed roller 122). Alternatively, the paper supply timing and the time for starting rotation of the pressure roller 152 may both be controlled.

The time for starting the paper supply also may be controlled by controlling the timing for driving the rollers and the like (e.g., registration roller) positioned between the paper feed roller 122 and the fixing device 150.

By taking the paper size with respect to a paper transporting direction into consideration, not only contact of the leading end but also contact of the trailing end of the paper with the high temperature area of the pressure roller 152 can be prevented.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device comprising:

a fixing roller heated by a heater;

a pressure roller for making pressure contact with said fixing roller so as to thermally fix onto a recording paper sheet an unfixed toner which is adhered thereto by transporting said paper sheet between the fixing roller and the pressure roller;

transporting mechanism for feeding and transporting a recording paper sheet from a feeding tray to the fixing roller and the pressure roller; and a controller which controls when a recording paper sheet is fed from the feeding tray, at least one of the rotation of the pressure roller and the transportation of the paper sheet by the transporting mechanism, so as to make a leading end of the paper sheet in a paper sheet transporting direction contact with a portion of an exterior circumference of the pressure roller which is not in contact with the fixing roller when the pressure roller is stopped.

2. The fixing device as claimed in claim 1, wherein said controller prohibits paper sheet feeding when a print command is received and the controller determines that the leading end of a paper sheet to be fed contacts with a portion of the exterior circumference of the pressure roller which is in contact with the fixing roller when said pressure roller is stopped.

3. The fixing device as claimed in claim 1 further comprising temperature detector for detecting a surface temperature of the pressure roller so as to detect a high temperature portion which appears periodically and corresponds to a portion of the exterior circumference of the pressure roller which is in contact with the fixing roller when the pressure roller is stopped, wherein said controller controls the transportation of a recording paper sheet based on a timing at which the high temperature portion is detected by said temperature detector.

4. The fixing roller as claimed in claim 1 further comprising a light emitter and a light receiver for receiving light emitted from the light emitter and then reflected from the pressing roller so as to detect a portion of the exterior circumference of the pressure roller which is in contact with the fixing roller when said pressure roller is stopped.

5. A fixing device comprising:

a fixing member;

a heater for heating said fixing member;

a pressure member which makes pressure contact with said fixing member so as to thermally fix an unfixed toner image onto a paper sheet disposed between said fixing member and said pressure member; and a controller for controlling the amount of heat generation of said heater so as to maintain the temperature of said fixing member at a predetermined target temperature, said controller changing the target temperature while one paper sheet is passing between said fixing member and said pressure member.

6. The fixing device as claimed in claim 5 further comprising identifying means which identifies a portion of the paper sheet which is disposed between the fixing member and the pressure member with respect to the paper transporting direction.

7. The fixing device as claimed in claim 6 wherein said controller increases the amount of the voltage applied to said heater when a trailing half of the paper sheet with respect to a sheet transporting direction is disposed between the fixing member and the pressure member.

8. A fixing device comprising:

a fixing member;

a heater for heating said fixing member;

a pressure member which makes pressure contact with said fixing member so as to thermally fix an unfixed toner image onto a paper sheet by transporting the paper sheet between said fixing member and said pressure member;

identifying means for identifying that a trailing half of the paper sheet with respect to a paper transporting direction is disposed between the fixing member and the pressure member; and a controller for controlling the mount of heat generation of said heater so as to maintain the temperature of said fixing member at a predetermined target temperature, said controller raising the target temperature when the trailing half of the paper sheet is disposed between the fixing member and the pressure member.

9. The fixing device as claimed in claim 8, wherein said controller controls the amount of heat generation of the heater by turning on and turning off the heater.

10. The fixing device as claimed in claim 8, wherein said identifying means includes a detector which detects a position of the paper sheet in the paper sheet transporting direction with respect to the fixing member.

11. The fixing device as claimed in claim 10, wherein said controller changes the target temperature in accordance with a position of the paper sheet detected by said detector.

12. A fixing device comprising:

a fixing member;

a heater for heating said fixing member;

a pressure member which makes pressure contact with said fixing member so as to thermally fix an unfixed toner image onto a paper sheet by transporting said paper sheet between said fixing member and said pressure member;

identifying means for identifying that a leading end portion or a trailing end portion of the paper sheet with respect to a paper sheet transporting direction is disposed between the fixing member and the pressure member; and a controller for controlling the amount of heat generation of said heater so as to maintain the temperature of said fixing member at a predetermined target temperature, said controller reducing the target temperature when at least one of the leading end portion of the paper sheet and the trailing end portion of the paper sheet passes between said fixing member and said pressure member.

13. The fixing device as claimed in claim 12, wherein said identifying means includes a detector for detecting a position of the paper sheet in the sheet transporting direction with respect to the fixing member.

14. The fixing device as claimed in claim 13, wherein said controller changes the target temperature in accordance with a position of the paper sheet detected by said detector.

15. The fixing device as claimed in claim 12, wherein said controller forcibly turns off the heater when at least one of the leading end portion and the trailing end portion of the paper sheet is disposed between the fixing member and the pressure member.

16. A fixing device comprising:

a fixing member;

a heater for heating said fixing member;

a pressure member which makes pressure contact with said fixing member so as to thermally fix an unfixed toner image onto a paper sheet by transporting the paper sheet between said fixing member and said pressure member;

identifying means for identifying that a trailing half of the paper sheet with respect to a paper transporting direction is disposed between the fixing member and the pressure member; and a controller for controlling the amount of heat generation of said heater so as to maintain the temperature of said fixing member at a predetermined target temperature, said controller continuously and forcibly turning on said heater when the trailing half of the paper sheet is disposed between the fixing member and the pressure member.

17. A fixing device comprising:

a fixing member;

a heater for heating said fixing member;

a pressure member which makes pressure contact with said fixing member so as to thermally fix an unfixed toner image onto a paper sheet by transporting said paper sheet between said fixing member and said pressure member;

identifying means for identifying that a leading end portion or a trailing end portion of the paper sheet with respect to a paper sheet transporting direction is disposed between the fixing member and the pressure member; and a controller for controlling the amount of heat generation of said heater so as to maintain the temperature of said fixing member at a predetermined target temperature, said controller continuously and forcibly turning off the heater when at least one of the leading end portion of the paper sheet and the trailing end portion of the paper sheet passes between said fixing member and said pressure member.

* * * * *

UNITED STATES PATENT AND TRADEMARK OFFICE

CERTIFICATE OF CORRECTION

PATENT NO. : 5,659,844

DATED : August 19, 1997

INVENTOR(S) : Tohru Fujiwara

It is certified that error appears in the above-indentified patent and that said Letters Patent is hereby corrected as shown below:

Column 23, line 56, delete "transporting mechanism" and insert --a transporting mechanism--.

Column 23, line 59, delete "a controller which controls" and insert --a controller which controls,--.

Column 24, line 20, delete "pressing roller" and insert --pressure roller--.

Signed and Sealed this

Fourteenth Day of July, 1998

Bruce Lehman

*Attest:*

BRUCE LEHMAN

*Attesting Officer*

*Commissioner of Patents and Trademarks*